US009169634B2

(12) United States Patent
Guerrero et al.

(10) Patent No.: US 9,169,634 B2
(45) Date of Patent: Oct. 27, 2015

(54) SYSTEM AND METHODS FOR ACTUATING REVERSIBLY EXPANDABLE STRUCTURES

(71) Applicant: SCHLUMBERGER TECHNOLOGY CORPORATION, Sugar Land, TX (US)

(72) Inventors: Julio C. Guerrero, Cambridge, MA (US); Logan Munro, New York, NY (US)

(73) Assignee: Schlumberger Technology Corporation, Cambridge, MA (US)

( * ) Notice: Subject to any disclaimer, the term of this patent is extended or adjusted under 35 U.S.C. 154(b) by 0 days.

(21) Appl. No.: 13/633,699

(22) Filed: Oct. 2, 2012

(65) Prior Publication Data

US 2013/0025215 A1 Jan. 31, 2013

Related U.S. Application Data

(62) Division of application No. 11/962,256, filed on Dec. 21, 2007, now Pat. No. 8,291,781.

(51) Int. Cl.
*E21B 23/00* (2006.01)
*E21B 43/10* (2006.01)
(Continued)

(52) U.S. Cl.
CPC ..... *E04B 1/344* (2013.01); *E21B 43/105* (2013.01); *A63F 9/088* (2013.01); *Y10T 74/18056* (2015.01); *Y10T 74/18296* (2015.01); *Y10T 74/18568* (2015.01); *Y10T 74/2115* (2015.01)

(58) Field of Classification Search
CPC ..... E21B 43/105; E21B 23/01; E21B 43/106; E21B 23/00; E21B 23/06; E21B 2023/008; E04B 1/342; E04B 1/344; F16H 25/14; Y10T 74/2115; Y10T 74/18056; Y10T 74/18568; Y10T 74/18296; A63F 9/088
USPC ..... 166/206, 381, 382; 52/81.2, 108; 74/55, 74/89
See application file for complete search history.

(56) References Cited

U.S. PATENT DOCUMENTS 366,365 A 7/1887 Averberg
3,066,637 A 12/1962 Akutowicz
(Continued)

FOREIGN PATENT DOCUMENTS

EP 0010601 A1 5/1980
EP 0010601 B1 5/1982
(Continued)

OTHER PUBLICATIONS

International Search Report of PCT Application No. PCT/IB2009/050550 dated Jan. 22, 2010.
Reynolds, "IV. On the Theory of Lubrication and its Application to Mr. Beauchamp Tower's Experiments, including an Experimental Determination of the Viscosity of Olive Oil," Philosophical Transactions of the Royal Society of London, 1886, vol. 177.—Part I: pp. 157-234.
(Continued)

*Primary Examiner* — Kenneth L Thompson
*Assistant Examiner* — Michael Wills, III
(74) *Attorney, Agent, or Firm* — Bridget M. Laffey; Jakub Michna; Daniel S. Matthews

(57) ABSTRACT

An actuator is provided for reconfiguring a reversibly expandable structure, also referred to as a deployable structure. The deployable structure includes an enclosed mechanical linkage capable of transformation between expanded and collapsed configurations while maintaining its shape. An actuator coupled to the deployable structure provides a load, force or torque for actuating a transformation. The actuated deployable structure transfers the actuation force to an external body substances, or element in contact with the deployable structure. The force can be directed inwardly or outwardly depending upon direction of the transformation (i.e., expanding or contracting). The force provided by the deployable structure can be used to perform work by its application over at least a portion of the distance traveled by a perimeter of the deployable structure during its transformation. In some embodiments, the actuatable deployable structure is lockable structure supporting a static load.

23 Claims, 16 Drawing Sheets

(51) Int. Cl.

| | |
|---|---|
| ***E04B 1/344*** | (2006.01) |
| *A63F 9/08* | (2006.01) |

(56) References Cited

U.S. PATENT DOCUMENTS

| | | | | |
|---|---|---|---|---|
| 3,282,248 | A | 11/1966 | Mann et al. | |
| 3,460,625 | A | 8/1969 | Hart et al. | |
| 3,575,238 | A | 4/1971 | Shillander | |
| 3,606,924 | A | 9/1971 | Malone | |
| 3,623,566 | A | 11/1971 | Orloff | |
| 3,982,248 | A | 9/1976 | Archer | |
| 4,105,215 | A | 8/1978 | Rathburn | |
| 4,222,577 | A | 9/1980 | Giffin | |
| 4,345,658 | A | 8/1982 | Danel et al. | |
| 4,424,861 | A | 1/1984 | Carter, Jr. et al. | |
| 4,501,327 | A | 2/1985 | Retz | |
| 4,787,302 | A | 11/1988 | Waltman et al. | |
| 4,836,289 | A | 6/1989 | Young | |
| 4,942,700 | A | 7/1990 | Hoberman | |
| 5,005,658 | A | 4/1991 | Bares et al. | |
| 5,024,031 | A | 6/1991 | Hoberman | |
| 5,038,532 | A | 8/1991 | Shahinpoor | |
| 5,069,572 | A | 12/1991 | Niksic | |
| 5,234,367 | A * | 8/1993 | DeCesare | 446/48 |
| 5,261,488 | A | 11/1993 | Gullet et al. | |
| 5,448,867 | A | 9/1995 | Wilson | |
| 5,655,558 | A * | 8/1997 | Child | 135/97 |
| 5,657,584 | A * | 8/1997 | Hamlin | 52/81.3 |
| 5,701,713 | A * | 12/1997 | Silver | 52/645 |
| 5,761,871 | A * | 6/1998 | Atake | 52/653.1 |
| 5,788,002 | A | 8/1998 | Richter | |
| 5,890,534 | A | 4/1999 | Burge et al. | |
| 6,056,055 | A | 5/2000 | Falconer et al. | |
| 6,082,056 | A | 7/2000 | Hoberman | |
| 6,089,323 | A * | 7/2000 | Newman et al. | 166/381 |
| 6,190,231 | B1 * | 2/2001 | Hoberman | 446/487 |
| 6,190,403 | B1 | 2/2001 | Fischell et al. | |
| 6,219,974 | B1 | 4/2001 | Hoberman | |
| 6,248,096 | B1 | 6/2001 | Dwork et al. | |
| 6,299,173 | B1 | 10/2001 | Lai | |
| 6,328,111 | B1 | 12/2001 | Bearden et al. | |
| 6,370,971 | B1 | 4/2002 | Olson | |
| 6,379,071 | B1 | 4/2002 | Sorvino | |
| 6,512,345 | B2 | 1/2003 | Borenstein et al. | |
| 6,513,601 | B1 | 2/2003 | Gunnarsson et al. | |
| 6,601,652 | B1 | 8/2003 | Moore et al. | |
| 6,673,106 | B2 | 1/2004 | Mitelberg et al. | |
| 6,910,533 | B2 * | 6/2005 | Guerrero | 166/206 |
| 6,945,992 | B2 | 9/2005 | Goodson, IV et al. | |
| 6,955,686 | B2 | 10/2005 | Majercak et al. | |
| 6,997,945 | B2 | 2/2006 | St. Germain | |
| 6,997,946 | B2 | 2/2006 | Girton et al. | |
| 7,044,245 | B2 | 5/2006 | Anhalt et al. | |
| 7,059,410 | B2 | 6/2006 | Bousche et al. | |
| 7,100,333 | B2 * | 9/2006 | Hoberman | 52/81.5 |
| 7,137,993 | B2 | 11/2006 | Acosta et al. | |
| 7,156,192 | B2 | 1/2007 | Guerrero et al. | |
| 7,234,533 | B2 * | 6/2007 | Gambier | 166/387 |
| 7,235,046 | B2 | 6/2007 | Anhalt et al. | |
| 7,334,642 | B2 | 2/2008 | Doering et al. | |
| 7,401,665 | B2 | 7/2008 | Guerrero et al. | |
| 7,540,215 | B2 * | 6/2009 | Hoberman et al. | 74/490.05 |
| 7,704,275 | B2 | 4/2010 | Schmid et al. | |
| 7,896,088 | B2 | 3/2011 | Guerrero et al. | |
| 2002/0042314 | A1 | 4/2002 | Mimura | |
| 2002/0107562 | A1 | 8/2002 | Hart et al. | |
| 2004/0080563 | A1 | 4/2004 | Leemhuis | |
| 2004/0097876 | A1 | 5/2004 | Shkolnik | |
| 2004/0220012 | A1 | 11/2004 | Siman-tov | |
| 2005/0000698 | A1 | 1/2005 | Bailey et al. | |
| 2005/0016302 | A1 | 1/2005 | Simpson et al. | |
| 2005/0090893 | A1 | 4/2005 | Kavteladze et al. | |
| 2005/0203605 | A1 | 9/2005 | Dolan | |
| 2005/0216076 | A1 | 9/2005 | Kveen et al. | |
| 2007/0089885 | A1 * | 4/2007 | George et al. | 166/382 |
| 2007/0089886 | A1 | 4/2007 | Orban et al. | |
| 2009/0158674 | A1 * | 6/2009 | Guerrero et al. | 52/81.2 |
| 2009/0159295 | A1 * | 6/2009 | Guerrero et al. | 166/382 |
| 2010/0243274 | A1 | 9/2010 | Guerrero et al. | |
| 2011/0132626 | A1 | 6/2011 | Guerrero et al. | |

FOREIGN PATENT DOCUMENTS

| | | | |
|---|---|---|---|
| EP | 0101805 | A1 | 6/1983 |
| EP | 0118619 | A1 | 9/1984 |
| EP | 0106016 | B1 | 12/1986 |
| EP | 0118619 | B1 | 9/1988 |
| EP | 0455850 | B1 | 5/1990 |
| EP | 0443408 | B1 | 2/1991 |
| EP | 1005884 | A2 | 6/2000 |
| EP | 1072295 | A2 | 1/2001 |
| EP | 1072295 | A3 | 1/2001 |
| EP | 1219754 | A1 | 1/2001 |
| EP | 1157188 | | 11/2001 |
| EP | 1073825 | B1 | 4/2002 |
| EP | 1350917 | B1 | 3/2008 |
| GB | 2347156 | | 8/2000 |
| GB | 2368082 | A | 4/2002 |
| GB | 2371066 | A | 7/2002 |
| GB | 2397084 | A | 10/2002 |
| RU | 646016 | C1 | 2/1979 |
| SU | 646016 | | 2/1979 |
| WO | 9727369 | A1 | 7/1997 |
| WO | 9727396 | | 7/1997 |
| WO | 0034620 | | 6/2000 |
| WO | 02063111 | A1 | 8/2002 |
| WO | 03054318 | | 7/2003 |
| WO | 03059207 | | 7/2003 |
| WO | 04000137 | | 12/2003 |
| WO | 2004075790 | | 9/2004 |
| WO | 2005008023 | A1 | 1/2005 |
| WO | 2005031115 | A1 | 4/2005 |

OTHER PUBLICATIONS

Abou et al., "Nonlinear rheology of Laponite suspensions under an external drive," Journal of Rheology, Jul./Aug. 2003, vol. 47(4): pp. 979-988.

Anonymous, "Asolene (Asolene) spixi (d'Orbigny, 1837)," The apple snail website, retrieved Mar. 11, 2009: pp. 1-3, <http://www.applesnail.net/content/species/asolene_asolene_spixi.htm>.

Ashmore et al., "Cavitation in a Lubrication Flow between a Moving Sphere and a Boundary," Physical Review Letters, 2005, PRL 94: pp. 124501-124501-4.

Balmforth et al., "A consistent thin-layer theory for Bingham plastics," J. Non-Newtonian Fluid Mech., 1999, vol. 84: pp. 65-81.

Cook et al., "MIT Scientists Copy the Snail's Pace," The Boston Globe, Jul. 2003: pp. 1-2, <http://nl.newsbank.com/nl-search/we/Archives?p_action=print>.

Hancock, "The self-propulsion of microscopic organisms through liquids," Proceedings of the Royal Society of London Series A. Mathematical and Physical Sciences, 1953, vol. 217: pp. 96-121.

Itoh et al., "Film Structured Soft Actuator for Biomimetics of Snail's Gastropod Locomotion," 6th International Conference Control, Automation, Robotics and Vision, 2000: pp. 1-5.

Lissmann, "The Mechanism of Locomotion in Gastropod Molluscs: I. Kinematics," The Journal of Experimental Biology, 1945, vol. XXI: pp. 58-69.

Lissmann, "The Mechanism of Locomotion in Gastropod Molluscs: I. Kinematics," The Journal of Experimental Biology, 1946, vol. XXII: pp. 37-50.

Mahadevan et al., "Biomimetic ratcheting motion of a soft, slender, sessile gel," PNAS, Jan. 2004, vol. 101(1): pp. 23-26.

Denny, A Quantitative Model for the Adhesive Locomotion of the Terrestrial Slug, Ariolimax Columbianus, J. exp. Biol., 1981, vol. 91: pp. 195-217.

(56) References Cited

OTHER PUBLICATIONS

Denny, "The role of gastropod pedal mucus in locomotion," Nature, May 1980, vol. 285: pp. 160-161.

Moffett, "Locomotion in the Promitive Pulmonate Snail Melampus Bidentatus: Foot Tructure and Function," Biol. Bull., Oct. 1979, vol. 157: pp. 306-319.

Skotheim et al., "Soft Lubrication," Physical Review Letters, Jun. 2004, vol. 92(24): pp. 245509-1-245509-4.

Taylor, "Analysis of the swimming of microscopic organisms," Proceedings of teh Royal Society of London, Series A, Mathematical and Physical Sciences, 1951, vol. 209: pp. 447-461.

Vles, "Zoology—On pedal waves of creeping mollusks," Comptes Rendus, Academie Des Sciences, Paris: Gauthier Villars, Imprimeur Libraire, 1907: pp. 276-278.

Willenbacher, "Article No. 0494: Unusual Thixotropic Properties of Aqueous Dispersions of Laponite RD," Journal of Colloid and Interface Science, 1996, vol. 182: pp. 501-510.

International Search Report of PCT Application No. PCT/US2008/087485 dated Oct. 26, 2009: pp. 1-4.

* cited by examiner

SYSTEM AND METHODS FOR ACTUATING REVERSIBLY EXPANDABLE STRUCTURES

CROSS-REFERENCE TO RELATED APPLICATION

This application is a divisional of U.S. patent application Ser. No. 11/962,256 filed Dec. 21, 2007, which is incorporated herein by reference in its entirety.

FIELD OF THE INVENTION

The present invention relates generally to the field of reversibly expandable loop assemblies. More particularly, the present invention relates to actuators for transforming reversibly expandable loop assemblies between expanded and collapsed states.

BACKGROUND OF THE INVENTION

A class of structures relates to self-supporting structures configured to expand or collapse, while maintaining their overall shape as they expand or collapse in a synchronized manner. Such structures have been used for diverse applications including architectural uses, public exhibits and unique folding toys. A basic building block of such structures is a "loop-assembly" that consists of three or more scissor units (described in U.S. Pat. Nos. 4,942,700 and 5,024,031) or polygon-link pairs (described in U.S. Pat. Nos. 6,082,056 and 6,219,974), each consisting of a pair of links that are pinned together at pivots lying near the middle of each link. Such a loop assembly includes a ring of interconnected links that can freely fold and unfold. Exemplary structures and methods for constructing such reversibly expandable truss-structures in a wide variety of shapes are described in the above referenced patents. Structures that transform in size or shape have numerous uses. If one desires to have a portable shelter of some kind, it should package down to a compact bundle (tents being a prime example).

SUMMARY OF THE INVENTION

The present invention relates to an actuator configured to transform a reversibly expandable or deployable structure (DS) between expanded and collapsed states. The deployable structures are formed by connecting linkage mechanisms having at least three scissor pairs that when their linkages are rotated with respect to each other at their joints, transform between expanded and collapsed states. The actuator supplies an actuation load, force or torque that initiates an expansion or contraction of an enclosed mechanical linkage of the deployable structure according to a direction of the force. The actuation load actuates during the whole deployment or contraction of the DS. The actuated deployable structure is capable of transferring an actuation force or torque (load, in general) to an external body, substances or elements in contact with the deployable structure through the enclosed mechanical linkage. In some applications, the actuated deployable structure is capable of performing work by applying a load, force or torque over a linear or angular displacement distance, the distance determined by variation of a perimeter of the deployable structure during its transformation. The work can be performed during an expansion cycle and during a contraction cycle.

One embodiment of the invention relates to a rotary actuator, including a first member having a first surface defining at least one track and a second member including an opposing surface defining at least one opposing track. The opposing surface is rotatably positioned opposite the first surface, such that at least a portion of the at least one track overlappingly intersects at least a portion of a respective one of the at least one opposing tracks. The overlapping intersection of the tracks defines an anchor point that is configured for slideable coupling to an anchor of a reversibly expandable structure. Rotation of the first member with respect to the second member transfers an actuation force to the expandable structure through the anchored connection.

Another embodiment of the invention relates to a rotary actuator including a first disk including a first surface defining more than one radial slot and a second disk including an opposing surface defining more than one opposing spiral slot. The opposing surfaces are rotatably positioned opposite each other, such that at least a portion of each of the more than one radial slots overlappingly intersect at least a portion of at least a respective one of the more than one opposing spiral slots. The at least one overlapping intersection defines an anchoring aperture configured for slideable coupling to an anchor of a reversibly expandable structure. Rotation of the first member with respect to the second member transfers an actuation force to the expandable structure through the anchored coupling.

Another embodiment of the invention relates to a reversibly expandable structure, including an enclosed mechanism conformed by multiple kinematics modules. Each of the modules is formed by sets of linkages connecting at pivot points. A minimum kinematics module has two linkages with a common pivoting joint. This module connects to at least another two modules, one on either side, through each of its four ends, two for each side. The system can have more complex kinematics modules with more than two linkages per module. An exemplary embodiment includes a simplest embodiment, having only two pivotally joined links per kinematics module (KM). Each pivotally joined kinematics module is pivotally joined to at least two adjacent pivotally joined kinematics modules forming the enclosed mechanical linkage. The enclosed mechanical linkage is transformable between open and closed configurations. The structure includes an actuator in communication with at least one of the pivotally joined kinematics modules. The actuator is configured to provide an actuation load, force, or torque for adjusting the at least one of the pivotally joined kinematics modules between its open and closed configurations. Adjustment of the angular relative rotation of the at least one kinematics module of the pivotally joined connected linkages induces similar adjustments in other pivotally joined kinematics modules of the plurality of pivotally joined kinematics modules. The resulting adjustments lead to transformation of the reversibly expandable structure along at least one reversibly expandable dimension of the enclosed mechanical linkage.

Yet another embodiment of the invention relates to a method for transferring a force to a body. An enclosed mechanical linkage including multiple pivotally joined kinematics modules is provided. The enclosed mechanical linkage is transformable between collapsed and expanded states. An actuation force is applied to at least one of the multiple pivotally joined kinematics modules varying a diameter of the enclosed mechanical linkage. At least a portion of the enclosed mechanical linkage is coupled to the body, wherein variation of the diameter of the enclosed mechanical linkage produces a force acting upon the body.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

The present invention relates to an actuator configured to operate reversibly expandable structure, also referred to as a deployable structure, including an enclosed mechanical linkage capable of transformation between expanded and collapsed configurations while maintaining its shape. The deployable structure includes an enclosed mechanical linkage coupled to the actuator for providing an actuation force to initiate a transformation of the deployable structure. The deployable structure system transfers the actuation force F to an external body through the enclosed mechanical linkage. The force can be directed radially inwardly or outwardly depending upon direction of the transformation (i.e., expanding or contracting). The force can be used to perform work by applying the force over at least a portion of the distance traveled by a perimeter of the deployable structure during its transformation. In some embodiments, the actuatable deployable structure system includes a locking feature, the locked structure supporting a static load. Alternatively or in addition, the actuatable deployable structure system can also include a compliant member for sealing against a surface.

Figure 1A:
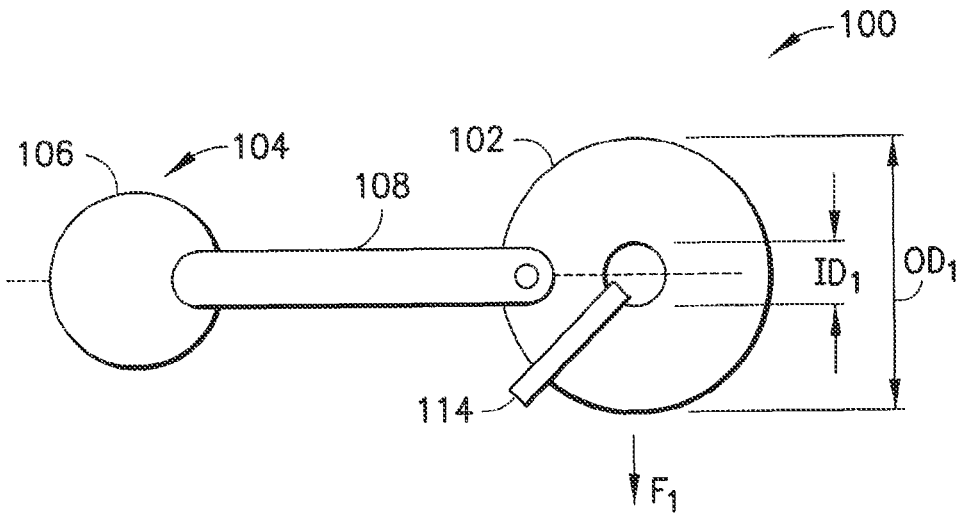
FIG. 1A and FIG. 1B respectively illustrate a schematic diagram of an actuatable deployable structure according to the present invention in collapsed and expanded states.

A schematic diagram of an actuatable deployable structure system 100 is shown in FIG. 1A. The actuatable deployable structure system 100 includes a reversibly expandable structure 102 coupled to an actuator 104. The reversibly expandable structure is transformable between expanded and collapsed states. In some embodiments, the reversibly expandable structure is an annular disk 102, as shown. The actuator 104 provides an actuation force for adjusting the reversibly expandable structure 102 between the collapsed and expanded states. The actuator 104 can include a force generator, or motor 106 providing the actuation force and a linkage 108 coupled between the motor 106 and the reversibly-expandable structure 102. The linkage 108 conveys the actuation force from the motor 106 to the reversibly expandable structure 102. In some embodiments, the motor 106 is coupled directly to the reversibly-expandable structure 102. Kinematics details of exemplary reversibly expandable structures, also referred to as deployable structures is provided in World Intellectual Property Organization Publication No. WO1997027369.

Figure 1B:
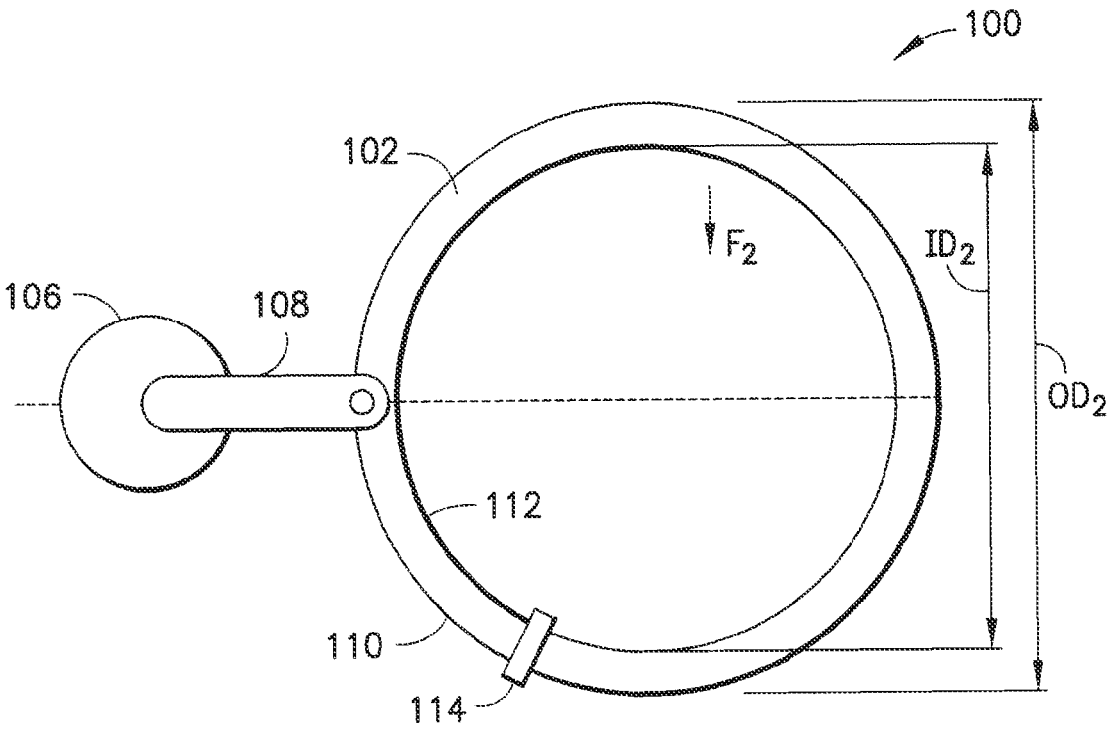

In the exemplary embodiment, the reversibly expandable structure 102 in its collapsed state is circular having an outside diameter OD1. In some embodiments, the deployable structure system is annular, also having an inside diameter ID1. In operation, the motor 106 generates an expansion actuation force coupled to the reversibly expandable structure 102 through the linkage 108 causing the reversibly expandable structure 102 in a collapsed state to expand. Upon application of a sufficient expansion actuation force, the reversibly expandable structure 102 is transformed, or expanded, to a fully expanded state as shown in FIG. 1B. In the expanded state, the reversibly expandable structure 102 can also be an annular structure having a fully expanded outside diameter OD2 that is greater than the outside diameter of the collapsed state (i.e., OD2>OD1). In the exemplary embodiment, the fully expanded inside diameter ID2 is also greater than the inside diameter of the collapsed state (ID2>ID1).

In some embodiments, the motor 106 remains coupled to the reversibly expandable structure 102 in the expanded state, producing a contracting activating force that reconfigures the reversibly expandable structure 102 from an expanded state (FIG. 1B) to a collapsed state (FIG. 1A). Transformation from a collapsed state to an expanded state can be referred to as an expansion stroke; whereas, transition from an expanded state to a collapsed state can be referred to as a contraction stroke. The actuatable deployable structure system 100 produces an outward directed force F1 during the expansion stroke, and an inward directed force F2 during the contraction stroke of the reversibly expandable device 102. The outward directed force F1 can perform work by its application over a distance traveled by a point on the reversibly expandable structure 102 during transformation from a collapsed state to an expanded state. For example, worked performed in an expansion stroke can be determined as the force F1 multiplied by the distance the external perimeter 110 travels during the expansion stroke: 0.5*(OD2−OD1). Likewise, the inward directed force F2 can also perform work by its application along the distance traveled by a point on the reversibly expandable structure 102, such as the distance internal perimeter 112 travels during a contraction stroke: 0.5*(ID2−ID1). In the exemplary annular embodiment, the forces F1, F2 are radially directed forces.

In some embodiments, the system includes a lock 114 configured to hold the reversibly expandable structure 102 in a fixed state of transformation between expanded and collapsed states. In a locked state, the reversibly expandable structure 102 can provide a loading force F1, F2 opposing loading of the device. For example, a lock can be engaged in at least one of the collapsed or expanded states to retain the reversibly expandable structure 102 in the locked configuration in the presence of external forces acting upon the structure. Keys 114 can include pins insertable into a mechanical linkage of the reversibly expandable structure 102 to prohibit expansion or contraction. In some embodiments, the motor 106 can function as a lock by providing an opposing force to prevent further expansion or collapse of the reversibly expandable structure 102 in a locked state.

In some embodiments, one of the inside or outside diameters remains substantially constant during transition from collapsed to expanded states, while the other one of the inside or outside diameters varies as just described. An exemplary structure in which the outside diameter remains substantially constant, while the inside diameter varies is described in U.S. Pat. No. 5,024,031.

The reversibly expandable device 102 is substantially planer, such that expansion and collapse occur parallel to a plane. Examples of such planar devices included the disk structures described herein. In some embodiments, the reversibly expandable device can be a three dimensional structure, such that expansion and collapse occur in three dimensions. Examples of some three dimensional structures include spherical devices.

Figure 2A:
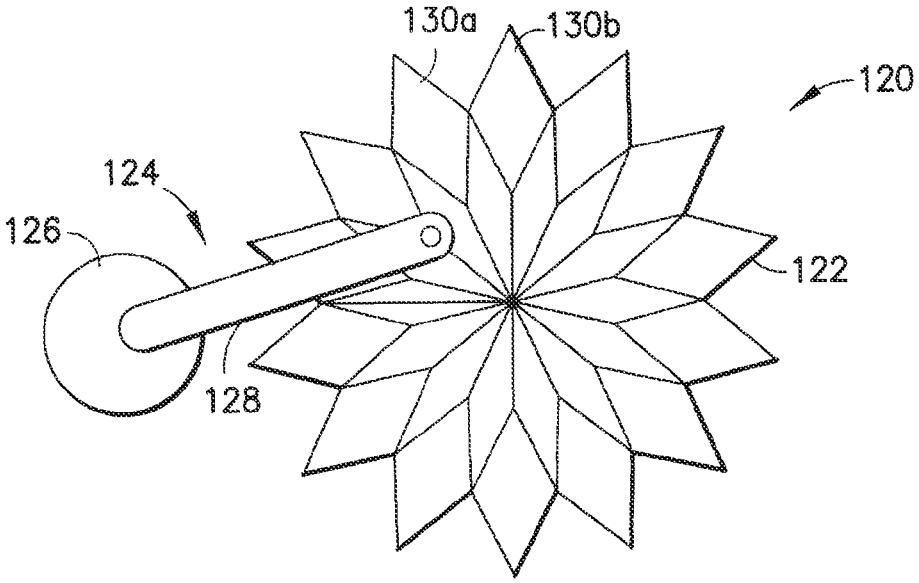
FIG. 2A and FIG. 2B respectively illustrate a planar view of one embodiment of a actuatable deployable structure system including a closed mechanical linkage of angulated elements according to the present invention in collapsed and expanded states.

FIG. 2A illustrates a planar view of an exemplary embodiment of an actuatable deployable structure system 120 including a reversibly expandable structure 122 formed from an enclosed mechanical linkage. The system 120 also includes an actuator 124 having a force generator, or motor 126 and a linkage 128 coupled between the motor 126 and the reversibly expandable structure 122. The enclosed mechanical linkage 122 in a collapsed state, as shown, covers a circular area without a central aperture. The enclosed mechanical linkage 122 includes a series of basic interlinked modules 130*a*, 130*b* (generally 130) arranged around a central point. In this embodiment, the deployable structure's kinematics modules have three linkages each.

Figure 2B:
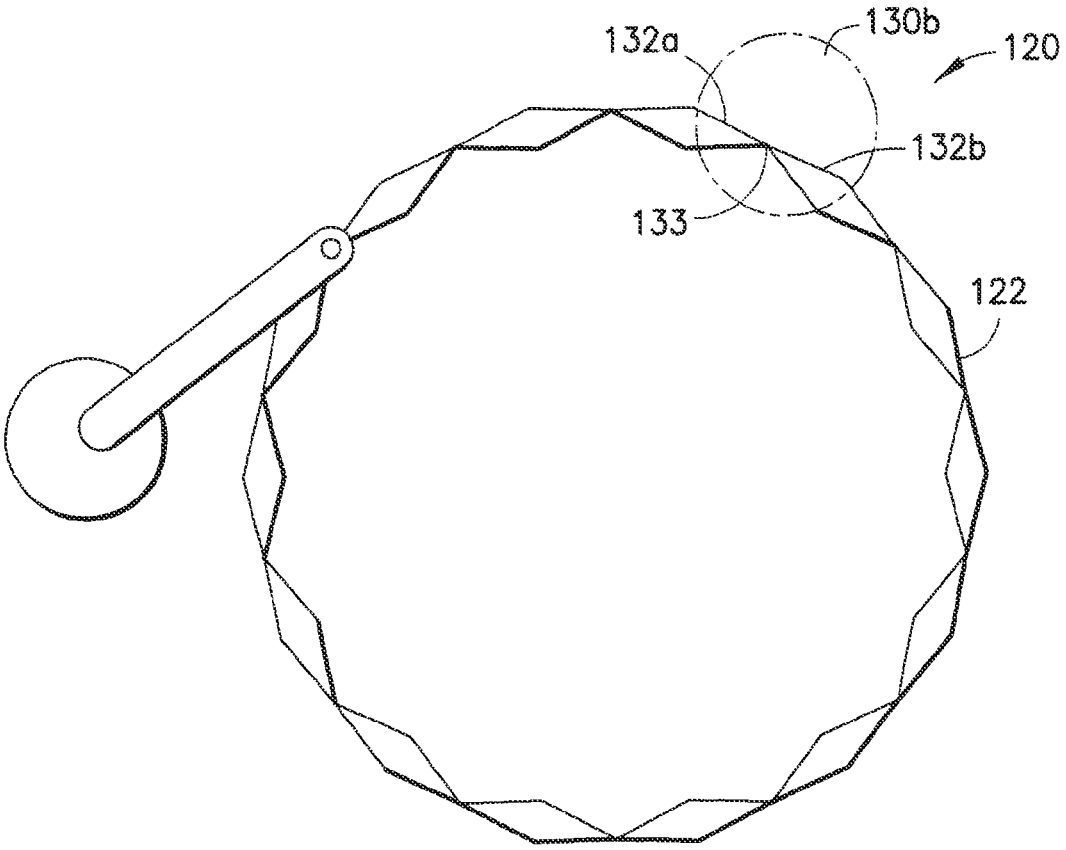

Referring now to FIG. 2B illustrating an expanded state of the actuatable deployable structure system 120, each of the basic interlinked modules 130, sometimes referred to as petals, includes a pair of pivotally interconnected members 132*a*, 132*b* (generally 132) that when actuated exhibit a scissor action about a central pivot 133. The ends of each interconnected member 132 are pivotally connected to respective ends of members of an adjacent element. By providing angles or kinks in the individual interconnected members 132, a closed loop is formed as shown. The shape of the closed loop can be circular, elliptical, polygonal and in general any arbitrary shape. Polygonal shaped closed loop structures are described in U.S. Pat. No. 5,024,031.

Figure 3B:
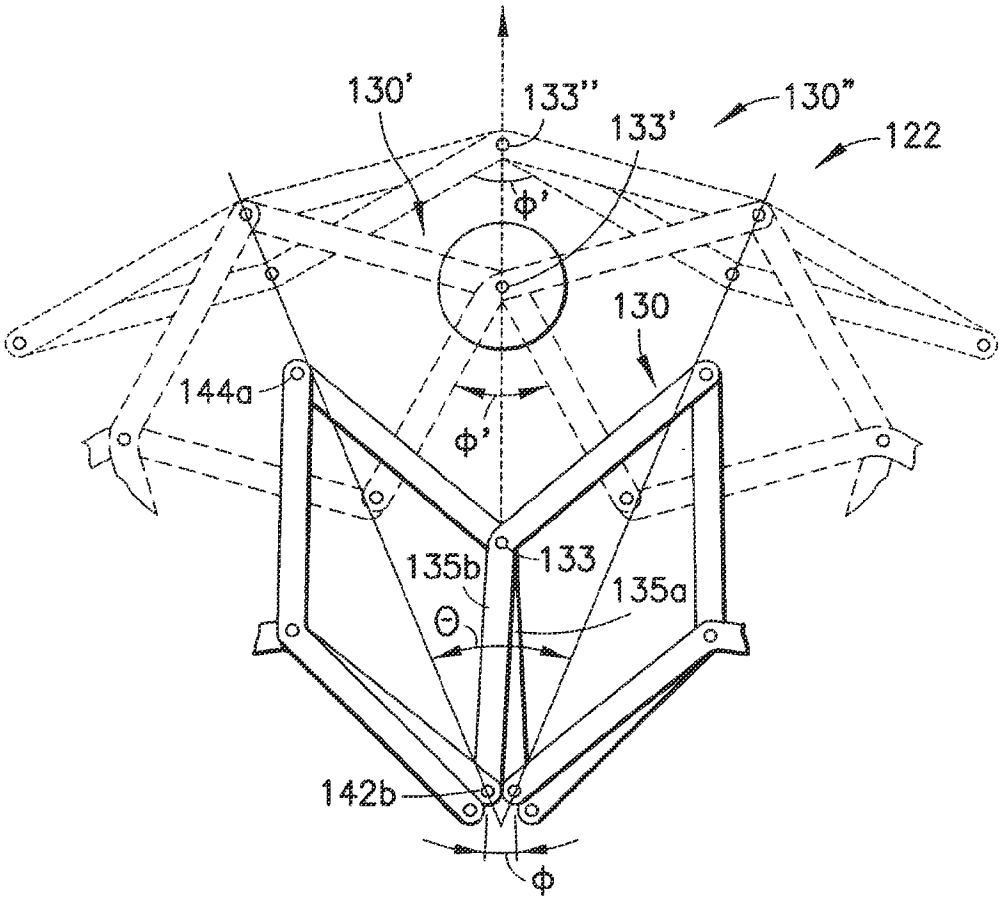
FIG. 3B illustrates a planar view of a segment of the basic module of FIG. 2A and FIG. 2B interlinked to similar basic modules forming a portion of a deployable structure, in collapsed, partially expanded, and expanded configurations according to the present invention.
Figure 3A:
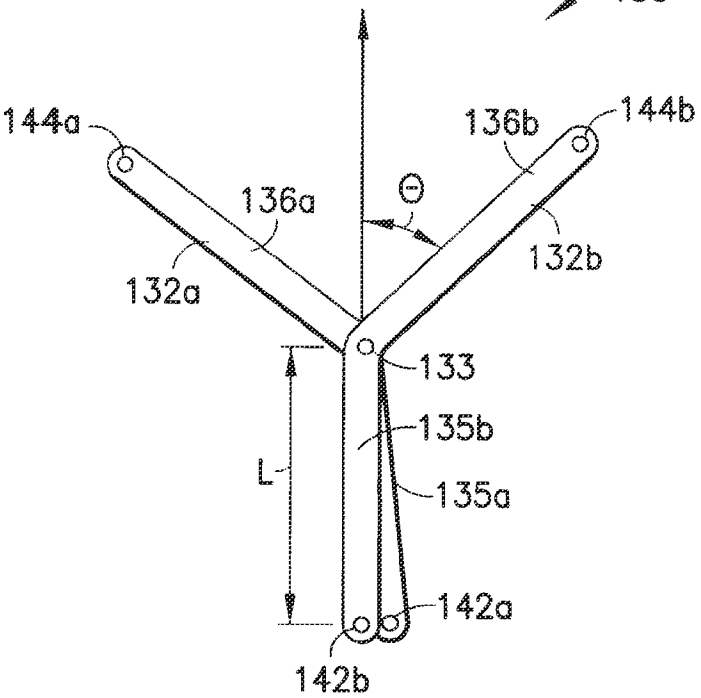
FIG. 3A illustrates a planar view of one embodiment of a basic module of the actuatable deployable structure system of FIG. 2A and FIG. 2B.

An exemplary basic module 130 of the reversibly expandable structure 122 is illustrated in more detail in FIG. 3A. The basic module 130 includes a pair of substantially rigid members or struts 132*a*, 132*b* pivotally joined around a central pivot 133. A left-hand strut 132*a* is angled, having a first linear portion 135*a* extending from the central pivot 133 to an inner right-hand pivot 142*a*. A second linear portion 136*a* of the left-hand strut 132*a* extends from the central pivot 133 to an outer left-hand pivot 144*a*. The second linear portion 136*a* is angled with respect to the first 135*a*, aligned at an angle θ from the first linear portion. This angle θ is referred to as a strut angle. A right-hand strut 132*b* can be substantially identical to the left-hand strut 132*a*, being aligned as a mirror image to the left-hand strut 132*a* with respect to a radius from the center of the reversibly expandable structure. Thus, the right-hand strut 132*b* is angled, having a first linear portion 135*b* extending from the central pivot 133 to an inner left-hand pivot 142*b*. A second linear portion 136*b* of the right-hand strut 132*b* extends from the central pivot 133 to an outer right-hand pivot 144*b*. The second linear portion 136*b* is angled with respect to the first 135*b*, also aligned at an angle θ from the first linear portion. In some embodiments, the left-hand strut 132*a* is different from the right-hand strut 132*b*.

A more detailed illustration of the basic module 130 integrated within the reversibly expandable structure 122 is illustrated in FIG. 3B. The basic module 130 is shown with its central pivot 133 aligned along a radius of the reversibly expandable structure 122. The outer left-hand pivot 144*a* is joined to an outer right-hand pivot of an adjacent basic module. The inner left-hand pivot 142*b* is joined to the inner right-hand pivot of an adjacent basic module. Similarly, the outer right-hand pivot 144*b* and the inner right-hand pivot 142*a* of the basic module 130 are joined to another adjacent basic module on an opposite side. An angle ϕ is formed between the first linear portions 135*a* of the left-hand strut 132*a* and the first linear portion 135*b* of the right-hand strut 132*b*. In a collapsed state, the angle ϕ is minimum. In the exemplary embodiment, the minimum angle ϕ approaches zero. However, due to a finite width of each strut 132*a*, 132*b* the minimum angle is slightly greater than zero.

As the reversibly expandable structure 122 transitions from a collapsed state to an expanded state, the first and second angle members 132*a*, 132*b* pivot with respect to each other such that the angle ϕ formed between the first angled portion of each of the angled members 132*a*, 132*b* increases. The basic module 130' is illustrated in phantom in a partially expanded state with an angle $\phi'>\phi$. The basic module 130" is illustrated in phantom again in a fully expanded state with an angle $\phi''>\phi'>\phi$. The central pivot 133, 133', 133" of the basic module 130, 130', 130" travels along a common radial line throughout transformation from collapsed to expanded states.

Throughout this transition, the basic module 130 remains pivotally interconnected to adjacent basic modules on either side through its left-hand and right-hand pivots 142*b*, 144*a*, 142*a*, 144*b*. The inner and outer pivots 142*b*, 144*a*, 142*a*, 144*b* pivot with respect to each of the adjacent basic modules, such that the inner and outer pivots 142*b*, 144*a* and 142*a*, 144*b* are drawn toward each other during an expansion stroke of the reversibly expandable structure 122. Drawing the inner and outer pivots together induces scissor action in the adjacent, pivotally connected basic modules that is likewise transmitted throughout each of the other modules of the reversibly expandable structure 122. Thus, it would be possible to reconfigure the reversibly expandable structure 122 between collapsed and expanded states by actuating a single basic module 130.

Although the first and second angled members 132*a*, 132*b* are illustrated as linear struts having the same basic angled shape, in some embodiments, they can have different shapes with respect to each other. Generally, the shapes of the first and second angled struts 132*a*, 132*b* control the shape of the reversibly expandable structure 122. By varying the relative shapes, different geometric structures can be obtained such as ellipses, polygons, and other arbitrary shapes. In the exemplary embodiment, all of the basic modules 130 of the reversibly expandable structure are identical. In some embodiments, one or more of the basic modules 130 can be different, again controlling the overall shape of the reversibly expandable structure 122. In some embodiments, one or more of the angled members can include a planar member such as a polygon. By including planar members, the reversibly expandable structure 122 can fill an area along the annular region covered by the reversibly expandable structure 122. This filled region can be used to occlude or block an opening.

Preferably, each of the angled members 132*a*, 132*b* of the basic module 130 are substantially rigid. Using rigid members 132*a*, 132*b* promotes transfer of force by the reversibly expandable structure 122*a* on an external body. Using rigid members 132*a*, 132*b* also promotes the reversibly expandable structure 122 maintaining its general shape during transitions between collapsed and expanded states. The angled members can be made from any suitable rigid material such as metals, alloys, polymers, composites, ceramics, glass, wood.

Figure 4:
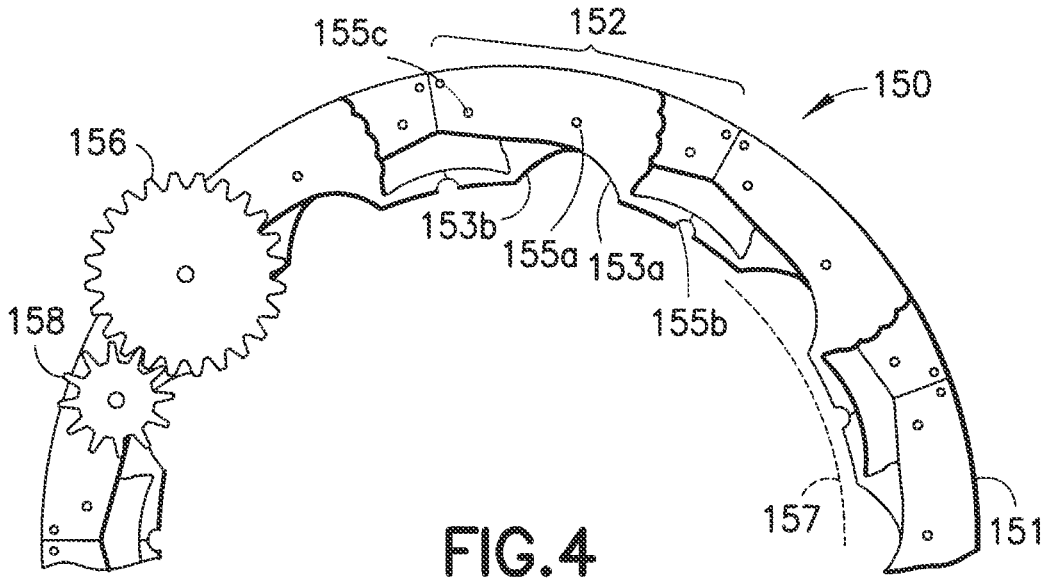
FIG. 4 illustrates a portion of an embodiment of a deployable structure system including a geared actuator linkage according to the present invention.

A portion of an exemplary embodiment of a circular reversibly expandable structure 150 is shown in FIG. 4. The reversibly expandable structure 150 is formed from an enclosed linkage of basic modules 152 having an outer perimeter 151 defined by a circular arc such that the joined basic modules 152 when fully expanded together form a continuous circular outer perimeter as shown. Each of the basic modules 152 includes a pair of substantially identical members 153*a*, 153*b* joined about a central pivot 155*a*, allowing a scissor action of the members 153*a*, 153*b*.

The reversibly expandable structure 150 can be transformed between collapsed and expanded states by a gear-driven actuator. In the exemplary embodiment, two gears 156, 158 are used in actuation of the device 150. The gears 156, 158 can be identically shaped or differently shaped. In the exemplary embodiment, a first gear 156 is larger than a second gear 158. The first and second gears 156, 158 mechanically engage each other such that rotation of one induces a rotation of the other. The relative angular velocities of the two gears 156, 158 are inversely related by their relative diameters.

At least one of the gears 156, 158 is fixedly coupled to one of the members 153*a*, 153*b* of the basic module 152. In the exemplary embodiment, the first gear 156 is fixedly coupled to one of the members 153*a* at its outer pivot 155*c*. Thus, rotation of the first gear 156 results in a corresponding rotation of the fixedly coupled member 153*a* about its pivot 155*a*. The second gear 158 is rotatably coupled to at least the other member 153*b* of the basic module 152, being allowed to freely rotate. In the exemplary embodiment, the second gear 158 is rotatably coupled to the central pivot 155*a* of the member 153*a* of the basic module 152. Rotation of either one of the first and second gears 156, 158 applies a torque to the first member 153*a* with respect to the second member 153*b*, causing the members 153*a*, 153*b* to rotate with respect to each other about their central pivot 155*a*. By linkage of the basic actuated module 152 to adjacent basic modules forming the enclosed reversibly expandable structure 150, scissor action of the actuated basic module 152 induces similar scissor action in each of the other basic modules of the reversibly expandable structure 150. Thus, actuation of one of the basic modules 152 with the geared actuator can vary the reversibly expandable structure between its collapsed and expanded states.

Figure 5:
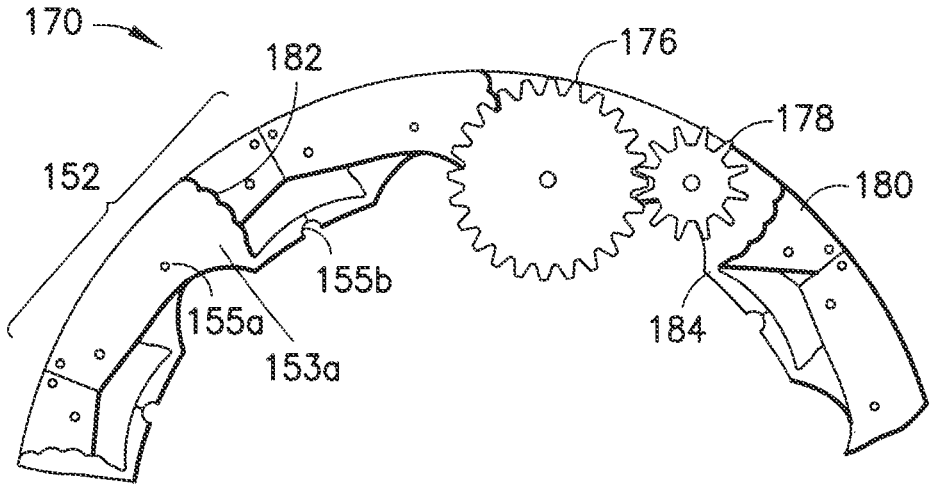
FIG. 5 illustrates a portion of another embodiment of a deployable structure system including a geared actuator linkage and a locking element according to the present invention.

Mounting the first, relatively large gear 156 about an external pivot 155*c* provides maximum clearance with respect to an internal aperture of an annular reversibly expandable structure 150, since a portion of the first gear 156 is positioned towards the outer perimeter 151. Such a configuration having maximum internal clearance is well suited for applications applying a force along an interior perimeter 157. An alternative embodiment of a similar reversibly expandable structure 170 is illustrated in FIG. 5, including a geared actuator configured to provide minimum interference with respect to an external perimeter. Such a configuration having minimum external interference is well suited for applications applying a force along an exterior perimeter 151.

In this embodiment, a second, relatively small gear 178 is rotatably coupled to one member 153*a* of the basic module 152 at its central pivot 160. A first, larger gear 176 is fixedly mounted to an internal pivot 155*b* of the other member 153*b* of the basic module 152. Rotation of the second gear 178 with respect to the first gear 176 induces a relative rotation of the members 153*a*, 153*b* of the basic module 152 about the central pivot 155*a*. Mounting the larger gear 176 with respect to the internal pivot 155*b* is preferred when the reversible structure 170 will be used for external loading. Thus, an external perimeter 151 of the reversibly expandable structure 170 can be applied to an external structure without interference of the larger gear 176. Of course, interference is also controlled by the diameters of the gears 156, 158 (FIG. 4), 176, 178 (FIG. 5), as well as the width of the annular members 153*a*, 153*b*.

In some embodiments, the reversibly expandable structure 170 includes one or more locking members 180. The locking members 180 can be used to lock the reversibly expandable structure 170 at one or more configurations between expanded and collapsed states to prevent further expansion or collapse of the structure 170. In some embodiments, the locking member 180 can be used to lock the reversibly expandable structure 170 in a fully expanded position. Alternatively or in addition, the locking member 180 can be used to lock the reversibly expandable structure 170 in a fully collapsed position. In some embodiments, the locking member 180 can be used to lock the reversibly expandable structure 170 in a selectable intermediate state between fully expanded and fully collapsed states.

In the exemplary embodiment, one or more of the angled members 153*a*, 153*b* of a basic module include a lockable surface 182. For example, the locking surface can include a locking surface 182 along one end of a first angled member 153*a* of the basic module 152. A separate locking member 180 is provided adjacent to the locking surface 182 and configured to engage the locking surface 182. In the exemplary embodiment, the locking surface 182 is a ratchet surface 182. The locking member includes a pawl 184 positioned to engage the ratchet surface 182, allowing movement in one direction, while preventing movement in an opposite direction. The ratchet surface 182 and the pawl 184 can be configured in a preferred direction to prevent collapsing of the reversibly expandable structure 170 while allowing further expansion, as illustrated. Alternatively, the ratchet surface 182 and pawl 184 can be configured in an opposite sense to prevent further expansion of the reversibly expandable structure 170 while allowing further collapse. In the exemplary embodiment, the locking member 180 is pivotally joined to at least one of the angled members 174*a*, 174*b*. In some embodiments, the locking member 180 can be a separate component that is used to engage one or more of the angled members 153*a*, 153*b*. For example, a locking member can include a pin or elongated rigid member that is insertable in an aperture of one or more of the angled members 153*a*, 153*b*. When the pin is inserted, further rotation of one of the members with respect to the other is prohibited, thereby locking the basic module 172 in its current state of deployment. A single locking member can be used to lock the entire reversibly expandable structure. In other embodiments, more than one locking members are used to provide greater strength. For example, a respective locking member can be provided for each of the basic modules 152.

Figure 6A:
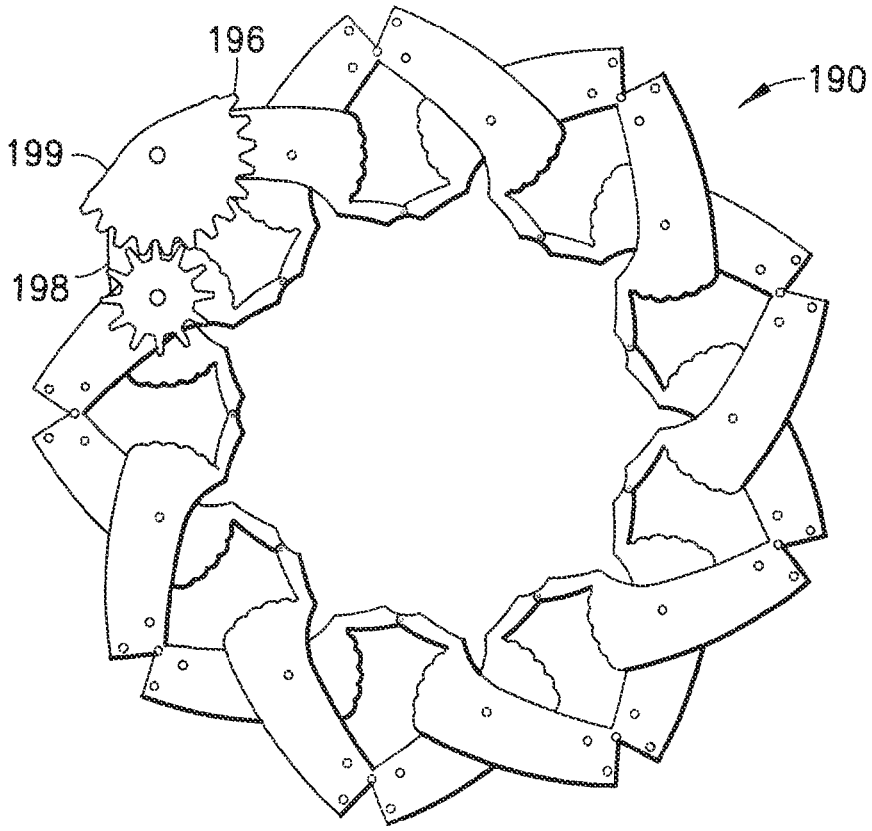
FIG. 6A illustrates yet another embodiment of a deployable structure system including a geared actuator linkage in partially expanded state according to the present invention.
Figure 6B:
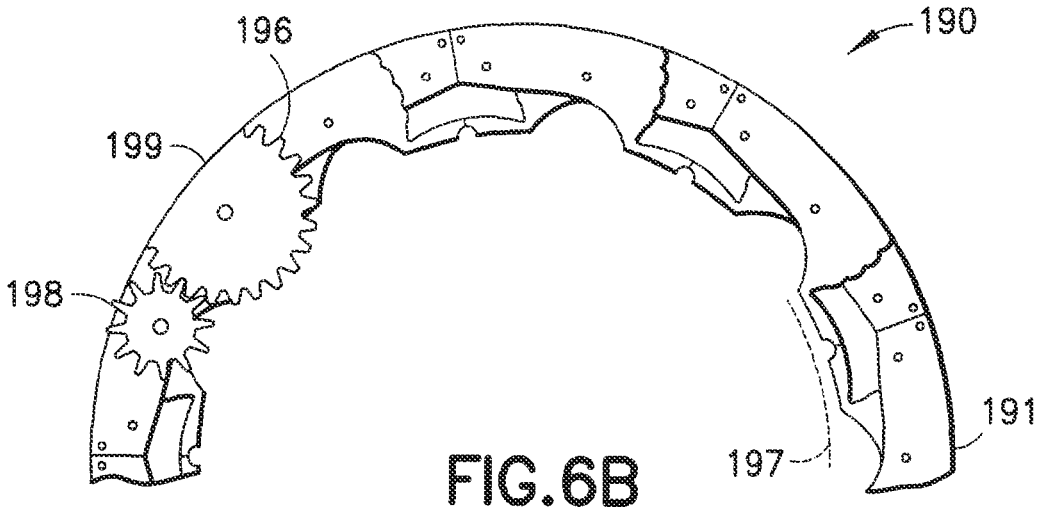
FIG. 6B illustrates a portion of the embodiment of the deployable structure system of FIG. 6A.

FIG. 6A and FIG. 6B illustrate another embodiment of a reversibly expandable structure 190 including a geared actuator. In this embodiment, a larger gear 196 is shown with an unused portion of the gear being removed providing a smooth surface 199. Removal of the unused portion of the larger gear 196 can benefit by allowing full expansion of the reversibly expandable structure without any portion of the larger gear extending beyond an outer perimeter 191 of the reversibly expandable device 190. The larger gear 196 can be coupled to the inner or outer pivots, provided that sufficient portion of the gear 196 is removed to prevent interference. Such treatment of the larger gear 196 allows use of larger gears having diameters greater than would otherwise be possible, allowing for a greater mechanical advantage. In some embodiments, the smooth surface 199 is aligned with an interior perimeter 197 to prevent interference along the interior.

Figure 7:
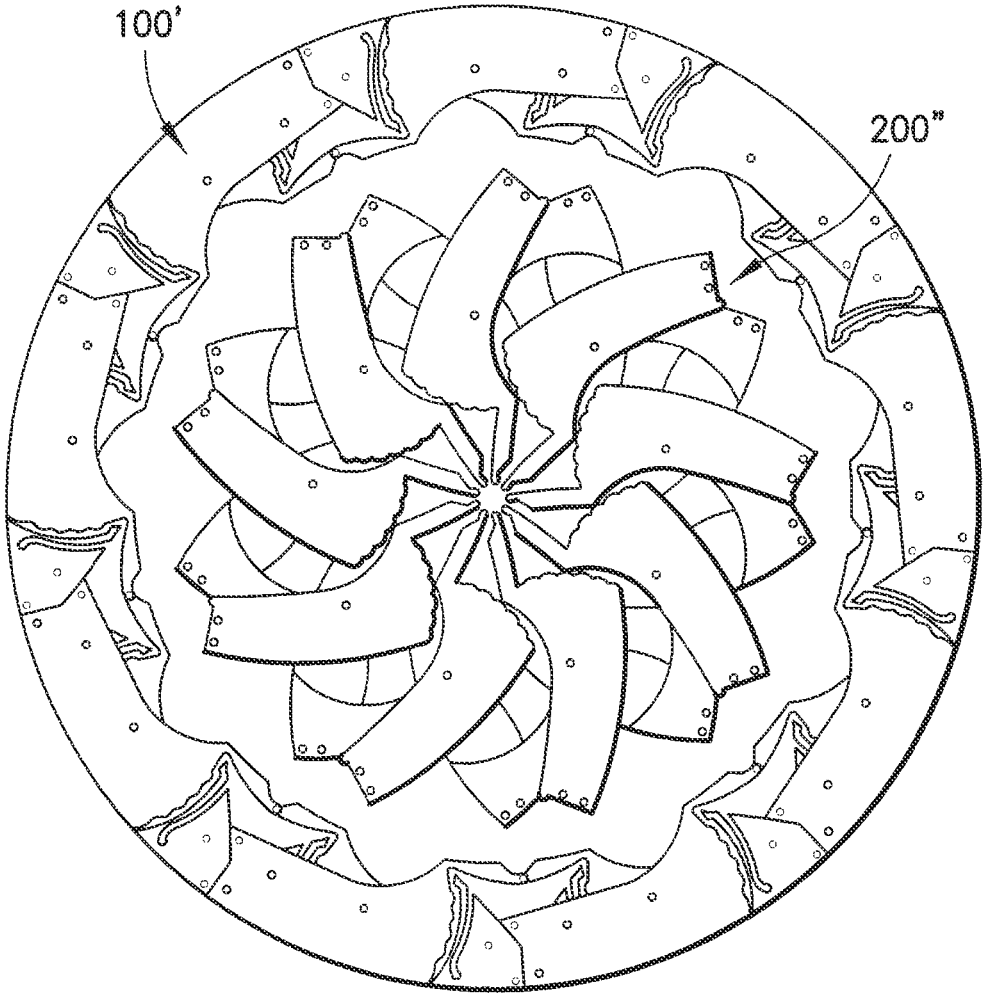
FIG. 7 illustrates a planar view of one embodiment of a first deployable structure of the deployable structure system according to the present invention in an expanded state with a similar second deployable structure in a collapsed state.

FIG. 7 illustrates a planar view of one embodiment of a first deployable structure according to the present invention in an expanded state 200' with a similar second deployable structure 200" in a collapsed state. In some embodiments, the reversibly expandable structures 200', 200" (generally 200) are configured such that an outer diameter in a collapsed state is less than an inner diameter in an expanded state (i.e., referring to FIG. 1, OD1<ID2) such that the collapsed structure 200" is able to pass completely within an interior aperture of the expanded structure 200' as shown.

Figure 8B:
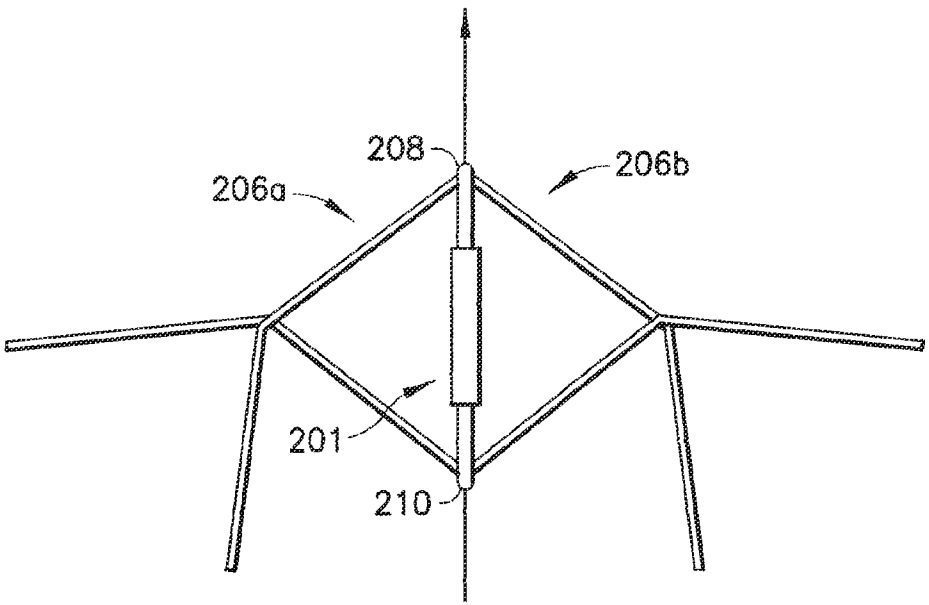
FIG. 8A and FIG. 8B respectively illustrate an exemplary angulated element including a linear actuator in a collapsed state and in an expanded state.
Figure 8A:
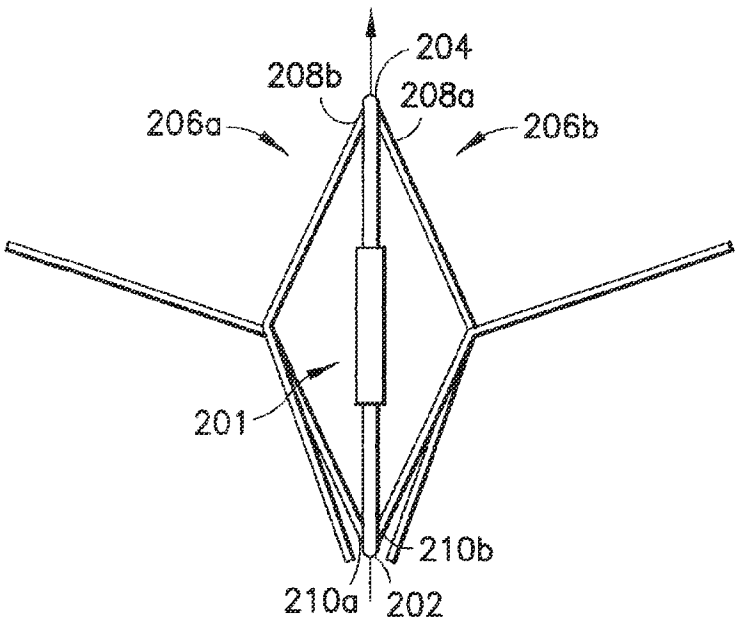

In some embodiments, a linear actuator is used to induce a torque causing pivoting of the basic modules and inducing the transition in a reversibly expandable structure between collapsed and expanded states. FIG. 8A and FIG. 8B illustrate an exemplary embodiment including a linear actuator 201. A portion of a reversibly expandable structure is illustrated including a first basic module 206*a* joined to a second basic module 206*b*. An outer right-hand pivot 208*b* of the first basic module 206*a* is joined to an outer left-hand pivot 208*a* of the second basic module 206*b*. Likewise, an inner right-hand pivot 210*a* of the first basic module 206*a* is joined to an inner left-hand pivot 210*b* of the second basic module 206*b*. The linear actuator 201 can be joined between the outer and inner pivot points 208, 210 of the adjacent basic modules 206*a*, 206*b*.

The linear actuator 201 includes an outer end 204 coupled to the outer pivot point 208 and an inner end 202 coupled to the inner pivot point 210. The linear actuator 201 is configured to vary in length according to an input signal. The exemplary linear actuator 201 is illustrated in an extended state providing maximum separation of the interior and exterior pivot points 208, 210. By extending the interior and exterior pivot points 210, 208 of the adjacent basic modules 206*a*, 206*b*, the exemplary reversibly expandable structure is transformed to a collapsed state as shown in FIG. 8A. The linear actuator 201 can be configured in a contracted state as shown in FIG. 8B. In the contracted state, the linear actuator 201 draws the interior pivot point 210 towards the exterior pivot point 208. By drawing the interior and exterior pivot points towards each other, the reversibly expandable structure is transformed into its expanded state.

The linear actuator 201 is a length adjustable or length-changing device. Such length-changing devices can be mechanical, electrical, electromechanical, hydraulic or pneumatic. For example, a linear actuator 201 can include a piston driven by pneumatic or hydraulic action between extended and contracted states. In other embodiments, the linear actuator can include a bolt-and-screw drive. For example, an elongated threaded shaft can be aligned between the pivot points. Each of the pivot points is coupled to the elongated threaded shaft through a bolt. Rotation of the threaded shaft causes linear displacement of the bolts along the length of the shaft according to the direction of rotation and the orientation of the threads. In other embodiments, the linear actuator includes a solenoid device. Electrical activation of a coil causes linear displacement of a bolt through the coil, thereby achieving extended and contracted states depending on activation of the coil. In some embodiments, the linear actuator 201 includes a linear motor such as a Lorentz force actuator. Position of the Lorentz force actuator is configurable between extended and contracted lengths and selectable lengths therebetween according to an activation signal provided to the coil. In some embodiments, the linear actuator 201 includes a phase-change material, such as a shape memory alloy. The linear actuator 201 may also contain piezoelectric devices configured to alter a length of the linear actuator 201.

Figure 9A:
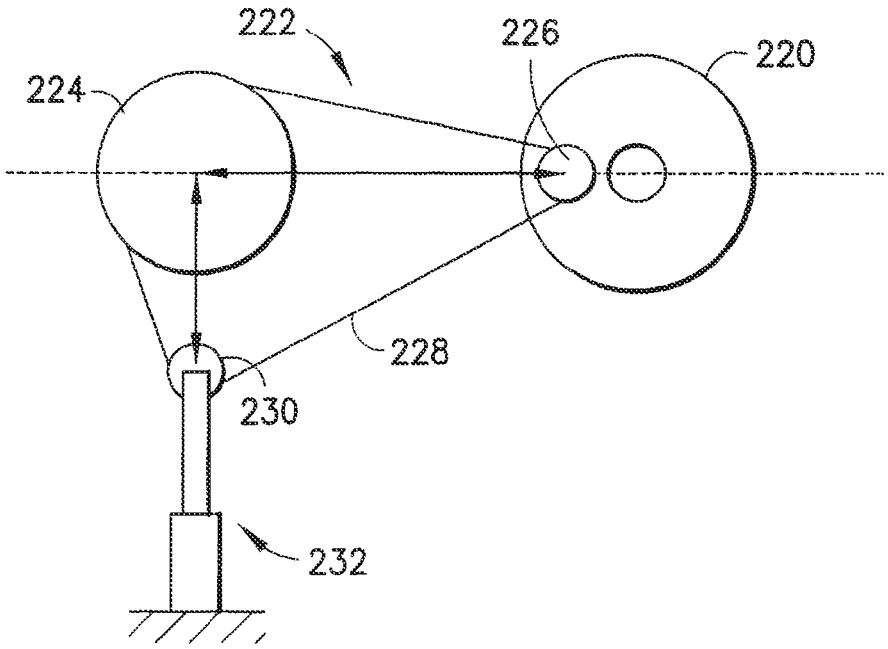
FIG. 9A and FIG. 9B respectively illustrate a schematic diagram of a deployable structure system with a belt and pulley drive actuator according to the present invention in collapsed and expanded states.
Figure 9B:
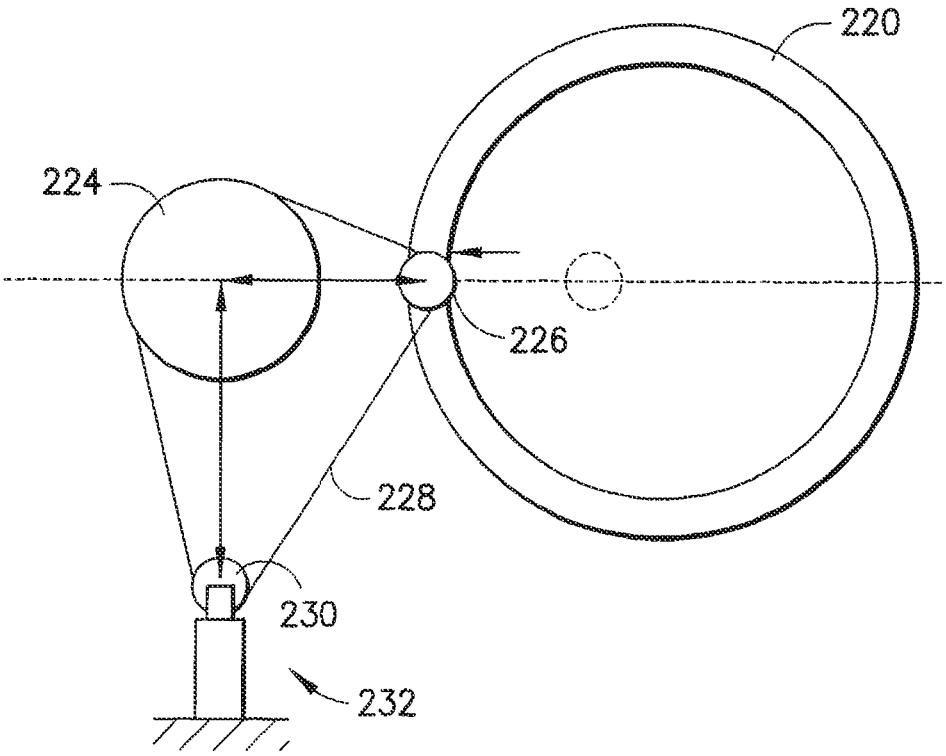

Referring now to FIG. 9A and FIG. 9B, a rotary actuator is coupled to a reversibly expandable device 220 through a belt-and-pulley mechanical linkage 222. The rotary actuator is coupled to a driving pulley 224. A driven pulley 226 is coupled to the reversibly expandable structure 220 such that rotation of the driven pulley 226 provides a torque rotating a basic module of the reversibly expandable structure 220. The applied torque can be in either direction controlling expansion or contraction of the reversible structure 220. The driving pulley 224 is coupled to the driven pulley 226 through a drive belt 228.

The reversibly expandable structure 220 is shown in a collapsed state in FIG. 9A. As the rotary actuator rotates the driving pulley 224 in one direction, the driven pulley 226 is rotated in the same direction by the drive belt 228. Rotation of the driven pulley 226 applies a torque to the reversibly expandable structure 220 causing the reversibly expandable structure 220 to transition to an expanded state as shown in FIG. 9B. In the exemplary embodiment, the driving pulley 224 and driven pulley 226 are aligned along a radius of the reversibly expandable structure 220. As the reversibly expandable structure 220 increases its radial dimension, the driven pulley 226 attached to the reversibly expandable structure 220 is translated along the radius as shown. When the driving pulley 224 is maintained at a fixed location with respect to the reversibly expandable structure 220, such translation of the driven pulley 226 along the radius will introduce a slack in the drive belt 228.

In order to maintain a tension within the drive belt 228, a tension pulley 230 is provided in communication with the drive belt 228. The tension pulley is orthogonally displaced from the radius joining the driving pulley 224 and the driven pulley 222. The tension pulley 230 is rotatably coupled to a length-adjustable device 232. The length-adjustable device 232 can include an elongated member rotatably coupled to the tension pulley 230 at one end and fixedly coupled at an opposite end with respect to a center point of the reversibly expandable structure 220. With the reversibly expandable structure 220 in a collapsed state, the driven pulley 226 is maximally displaced from the driving pulley 224 along the radius. The length-adjustable device 232 is maximally extended such that the tension pulley 230 is relatively close to the radius. As the reversibly expandable structure 220 transitions to an expanded state, the driven pulley 226 migrates toward the driving pulley 224. In order to maintain belt tension, the length-adjustable device 232 is adjusted to a minimum length such that the tension pulley 230 takes up slack within the belt 228. In some embodiments, the length adjustable device includes a spring. Alternatively or in addition, the length adjustable device includes a piston, which may be hydraulic or pneumatic, a belt-and-screw drive, a solenoid, a linear motor, a phase change material, such as a shaped memory allow, or a combination of one or more of these devices. Although the exemplary embodiment has been described in the configuration of a belt-and-pulley drive, a similar actuator could be accomplished with a chain-and-sprocket drive. Thus, the pulleys 224, 226, 230 would be replaced by sprockets and the drive belt 228 would be replaced by a drive chain.

Figure 10A:
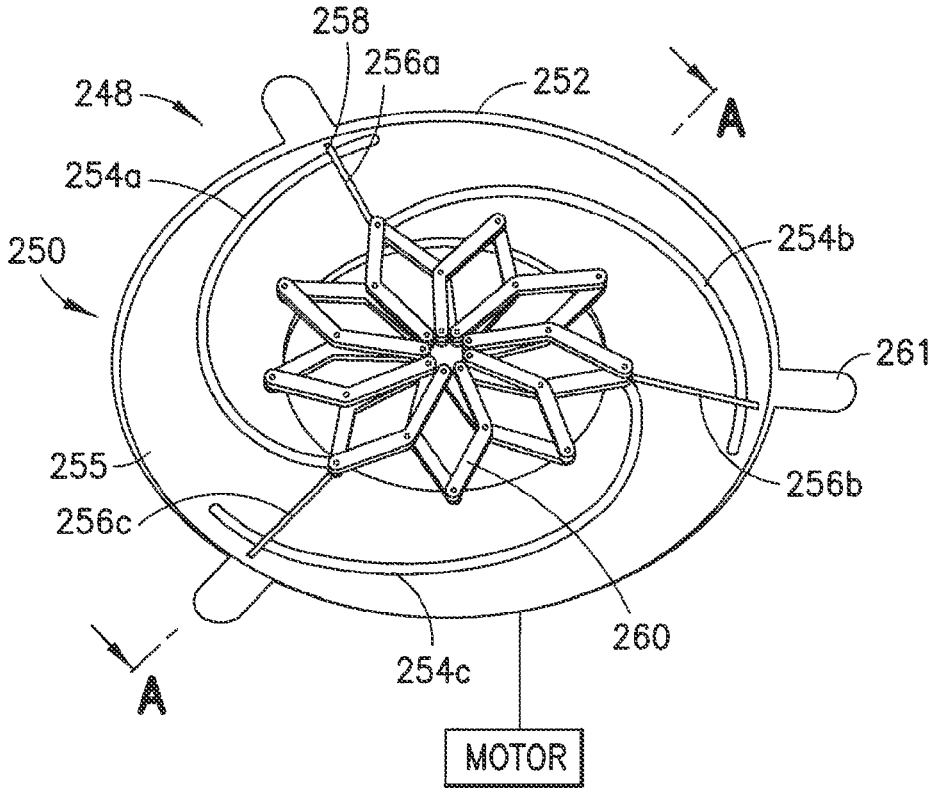
FIG. 10A illustrates a perspective view of a rotary disk actuator configured to actuating a deployable structure according to the present invention.

In some embodiments, referring now to FIG. 10A, an actuatable deployable structure system 248 includes a reversibly expandable structure 260 and a rotatable disk actuator 250. The rotatable disk actuator 250 includes a first disk 252 having one or more rotating tracks 254*a*, 254*b*, 254*c* (generally 254). The rotatable disk actuator 250 also includes a second disk 255 including one or more radial tracks 256*a*, 256*b*, 256*c* (generally 256). An overlap 258 of one or more of the rotary tracks 254 with a respective radial tracks 256 of the second disk 255 results when the first and second disks 252, 255 are placed adjacent to each other.

One or more fixed points on the reversibly expandable structure 260 are configured for capture by the overlap 258. Rotation of the first disk 252 with respect to the second disk 255 results in a controlled translation of each overlap 258 along its respective radial track 256. Resulting translation of the overlap 258 is coupled to the fixed point on the reversibly expandable structure 260. Translation of the fixed point applies a torque to a respective basic structure 262 of the reversibly expandable structure 260. Thus, rotation of the first disk 252 with respect to the second disk 255 can be used to control transformation of the reversibly expandable structure 260 between collapsed and expanded states.

In an illustrative embodiment including a rotatable disk actuator 250, the first disk 252 includes three right-hand spiral tracks 254*a*, 254*b*, 254*c* spaced apart from each other by 120°. The second disk 255 includes three radial tracks 256*a*, 256*b*, 256*c* also spaced apart from each other by 120°. The length of the radial tracks 256 can be sufficient to cover full radial displacement of the spiral tracks 254. In some embodiments, the spiral tracks 254 are slotted apertures cut through from one side of the disk 252 to the other. In other embodiments, the spiral tracks 254 are grooves formed along a surface of the first disk 252 facing the second disk 255. The radial tracks 256 can also be slotted apertures cut from one side of the second disk to the other. Generally, at least one of the spiral tracks 254 and radial tracks 156 is a through aperture extending from one side of the respective disk to the other. The other of the spiral tracks 254 and radial tracks 156 can be a through aperture, or a groove.

In some embodiments, fixed points on the reversibly expandable structure 160 aligned with respective overlaps 258 coincide with pivot points of the reversibly expandable structure 260. An extension of such a pivot point can be extended to pass through an adjacent radial slot 256 and extend into a corresponding spiral slot 254 at the overlap 258. When the reversibly expandable structure is positioned along an opposite side of the actuator 148, the extension of the pivot point can be extended to pass through an adjacent spiral slot 154 and extend into a corresponding radial slot. Thus, as the first disk 252 is rotated with respect to the second disk 255, the overlap is captured to one of the pivot points through the extended joint such that the pivot point is translated in a radial direction. In this manner, the reversibly expandable structure 260 can be transformed between its collapsed and expanded states, depending upon the orientation of the spiral (right-hand or left-hand spiral) and the direction of relative rotation of the disks 252, 255.

Figure 10B:
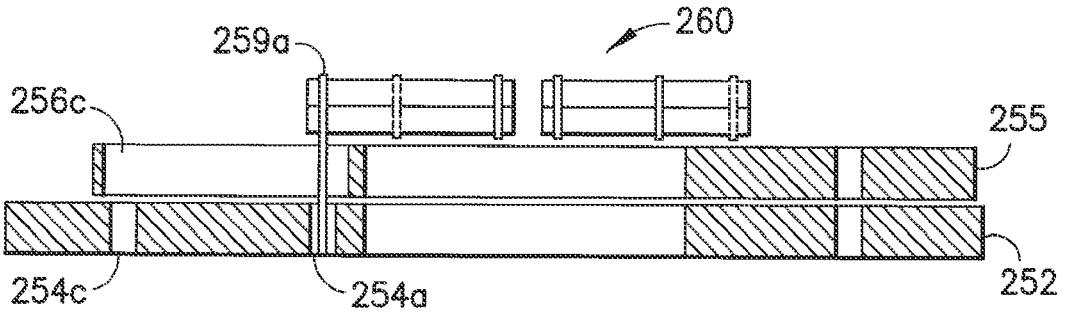
FIG. 10B is a cross sectional view of the rotary disk actuator of FIG. 10A along A-A.

A cross-section of the exemplary system including the rotatable disk actuator 250 taken along A-A is illustrated in FIG. 10B. In the exemplary embodiment, the first disk 252 is shown as a base with the second disk 255 layered upon a top surface. The reversibly expandable structure 260 is positioned along an opposite surface of the second disk 255, such that the second disk 255 is sandwiched between the reversibly expandable structure 260 and the first disk 252 as shown. Several joints of the reversibly expandable structure 260 are shown with one of the joints 259 including an extension directed toward the first and second disks 252, 255. The extension is aligned through a first radial slot 256*c* and extending into a corresponding first spiral slot 254*a*. In this manner, a pivot 259 of the reversibly expandable structure 260 is captured by an overlap of the radial track 256 and the spiral track 254.

In some embodiments, one of the disks includes a feature to facilitate relative rotation of the disks 252, 255. In the exemplary embodiment, the first disk 252 includes three tabs 261 that can be used as bearing surfaces to rotate the bottom disk 255. In some embodiments, one of the disks is fixedly mounted to an external structure. In other embodiments, both disks 252, 255 include tabs 261. Alternatively or in addition, one or more of the first and second disks 252, 255 can include a gear surface along an external or internal perimeter. The geared surface is engagable by another gear coupled to motor providing a torque for rotating at least one of the disks 252, 255.

Figure 11:
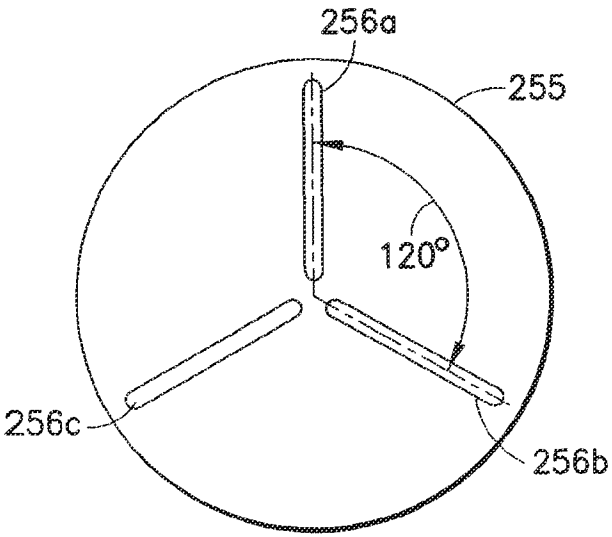
FIG. 11 illustrates a planar view of an exemplary fixed disk of the rotary disk actuator of FIG. 10A.

FIG. 11 illustrates the second disk 255 including three radial slots 256*a*, 256*b*, 256*c* extending outward from a center portion of the disk 255 and spaced apart from each other by 120°. In some embodiments, different numbers of radial slots can be provided. The second disk 255 is preferably formed from a rigid material to maintain its shape during operation providing a straight radial slot.

Figure 12A:
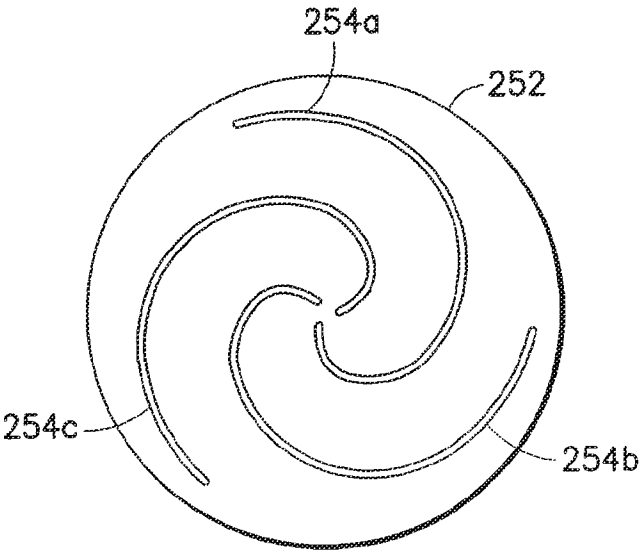
FIG. 12A and FIG. 12B illustrate planar views of different embodiments of rotary disks of the exemplary rotary disk actuator FIG. 10A.

FIG. 12A illustrates an embodiment of the first disk 252 including three right-hand spiral slots 254*a*, 254*b*, 254*c*. Each spiral slot 254 extends from a first radius near the center of the disk 252 to a second radius approaching an external perimeter of the disk as shown. The particular spiral slot 254 can be defined in polar coordinates as a function of the angle about a center of the disk 252. In this embodiment, a complete spiral slot 254 extends for about 240° of rotation.

Figure 12B:
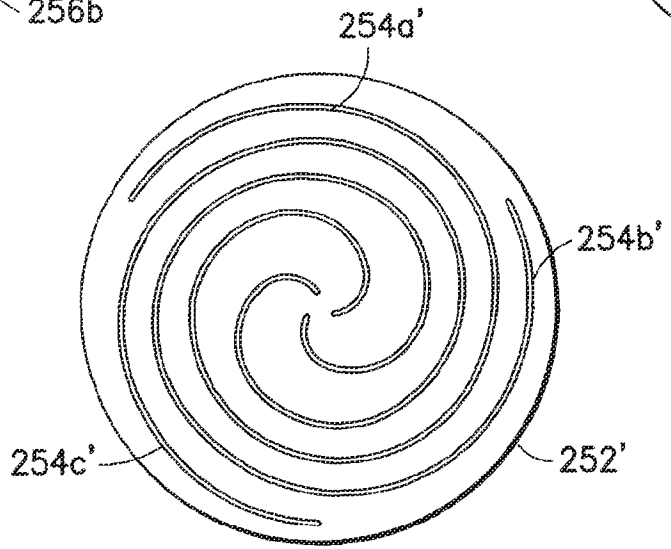

A second embodiment of the first disk 252' is illustrated in FIG. 12B, also including three spiral slots 254*a*', 254*b*', 254*c*' (generally 254'). Each spiral slot 254' also extends from the first radius near the center of the disk 252' to a second radius approaching an external perimeter of the disk 252'. However, each spiral slot 254' extends for approximately 570° of rotation. The particular shapes of the spirals slots 254' can be defined in polar coordinates as a function of angle that can be selected according to a particular application. In some embodiments, the spirals correspond to a rotary wedge and provide a mechanical advantage similar manner to a wedge. Thus, the spirals 254 of the embodiment of the first disk 252 shown in FIG. 12A correspond to a wedge having a relatively steep slope whereas the spirals of the second embodiment of the first disk 252' illustrated in FIG. 12B correspond to a wedge having a relatively shallow slope.

On rotation, the spiral shape of the first disk 252 will push the joints along the radial slots of the second disk 255, deploying the structure. In some embodiments the second disk 255 is fixed in place, while the first disk 252 is rotated. A torque is applied to the first disk 252 to cause its rotation. Energy conservation dictates that the speed of expansion of the deployable device is inversely proportional to the force of expansion F.

$$\dot{\theta}_{rotating} \cdot \tau_{rotating} = \dot{R}_{device} \cdot \sum |F_{device}|$$
$$\rightarrow \dot{R}_{device} = \dot{\theta} \frac{\tau_{rotating}}{\sum |F_{device}|},$$

where the quantity after θ is the ratio of the torque exerted on the system to the force exerted on the device. This ratio is the force multiplication ratio, which can be altered by changing the shape of the slotted paths of the first, rotating disk 252. For example, a rotating disk with slotted paths that have a length several times that of the disk's radius will produce a large expansion force, but will subsequently require multiple rotations of the disk to fully expand the device. With a function of the slotted path defined in polar coordinates, r=f(θ). The derivative of the path radius with respect to ∝ also provides the torque multiplication factor. A disk that produces a constant force multiplication regardless of expansion in diameter has the slotted path equation of r=a·θ.

A plane view of an exemplary rotatable disk actuator 250 is illustrated in FIG. 13. A second disk 255 is placed upon the first disk 252 aligned concentrically. The overlapping intersections 258*a*', 258*a*", 258*b*', 258*b*", 258*c*', 258*c*" (generally 258) of the rotating tracks 254 and the radial tracks 256 are shown. An extension of a respective one of the pivotal joints 259*a*, 259*b*, 259*c* (generally 259) of the reversibly expandable structure 260 is shown disposed within an inner one of each of the inner overlapping intersections 258 of each radial track 256. Rotation of the second disk 255 with respect to the first disk 252 in the direction of the angle √ shown, translates the overlapping intersections 258 outward from the center of the disks, along the radial tracks 256. This outward movement of the intersection 258 applies an outward directed force to the pivotal joint extension 259 captured within the overlapping intersection 258. A respective outward force is provided in each of the pivotal joint extensions captured within the overlapping intersections 258 which in turn actuates the deployable structure 260 (not shown). For example, the outward directed force transforms a reversibly expandable structure 260 from a collapsed to an expanded state. This represents a so-called expansion stroke that in turn can apply a force through the expandable structure 260 to do work.

Figure 13A:
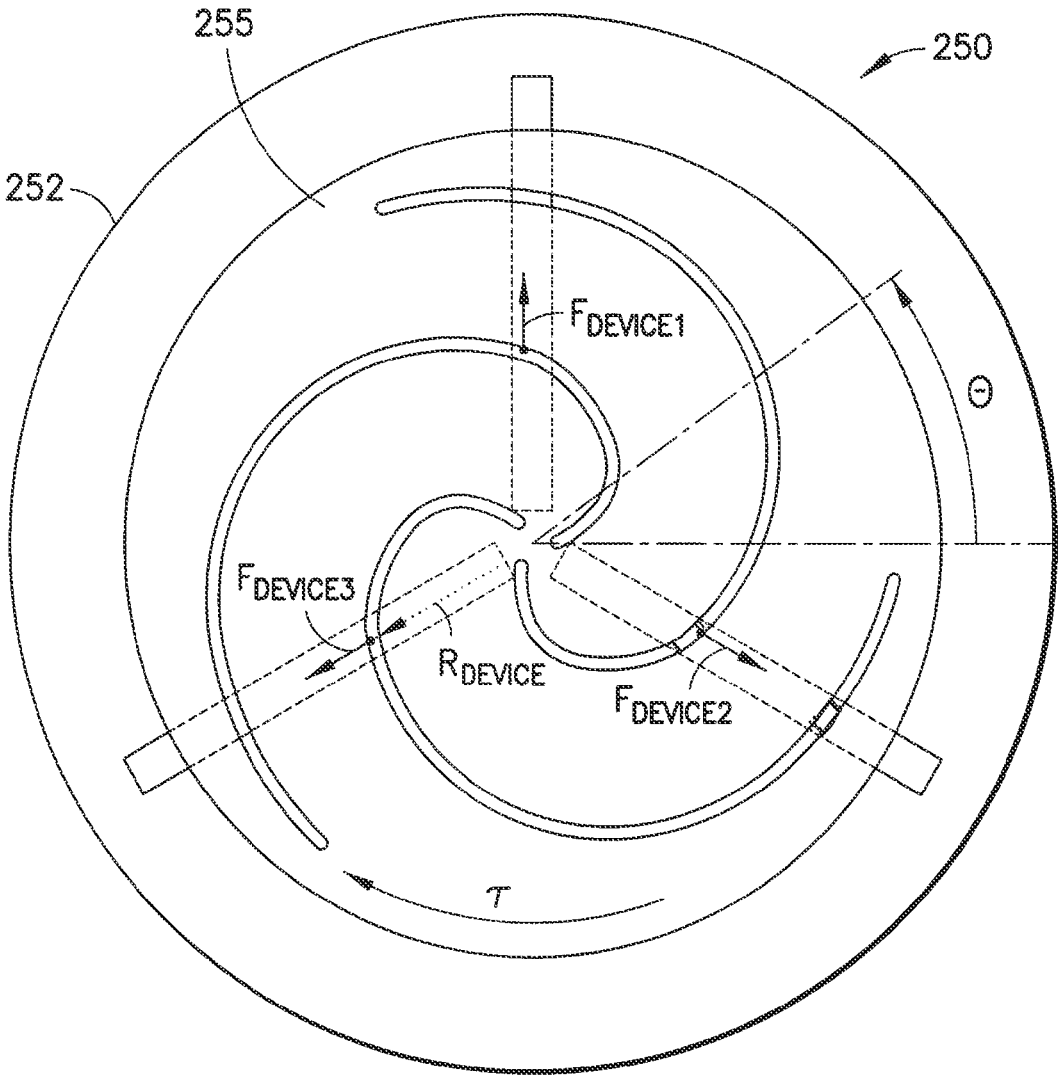
FIG. 13A, FIG. 13B, FIG. 13C and FIG. 13D are planar views of the exemplary rotary disk actuator of FIG. 10A in different stages of actuation.
Figure 13B:
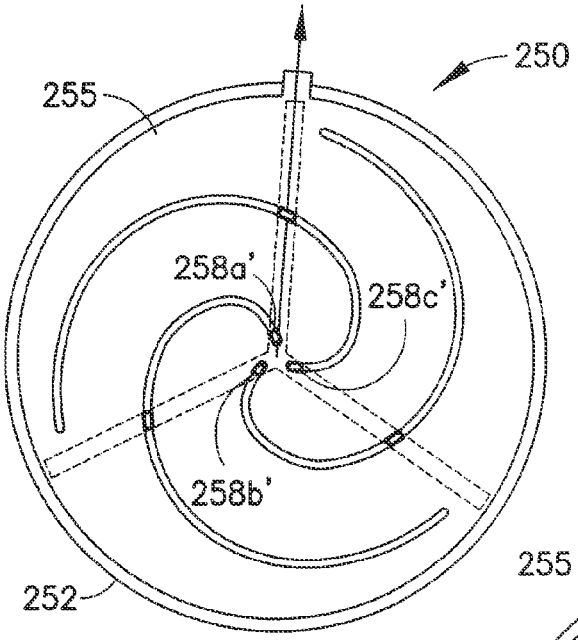
Figure 13C:
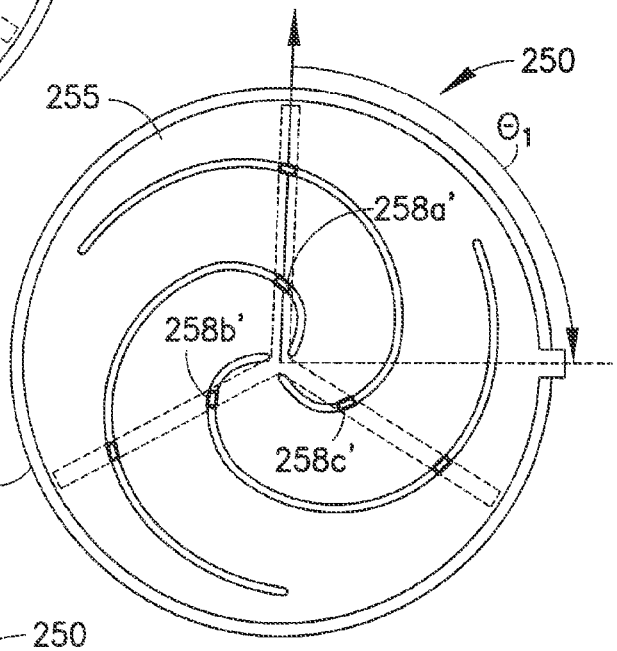
Figure 13D:
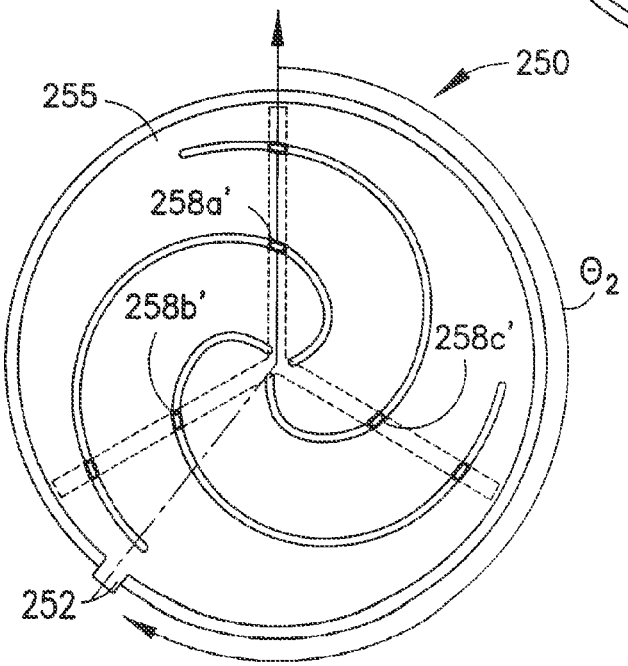

FIG. 13B, FIG. 13C, and FIG. 13D together illustrate three different rotations of the first and second disks 255, 252 with respect to each other also showing the overlapping intersections 258 with each orientation. For example, FIG. 13B can illustrate a collapsed configuration in which the overlapping intersections 259 are disposed at a minimum radius in the inner overlapping intersections 258' with respect to the disks 255, 252. FIG. 13C illustrates a partially expanded configuration, after a rotation of angle θ1 in which the inner overlapping intersections 258' are located midway along the radial tracks 256. FIG. 13D illustrates a fully expanded configuration, after a rotation of angle θ2 in which the inner overlapping intersections 258' are maximally positioned along the radial tracks 256.

Figure 14B:
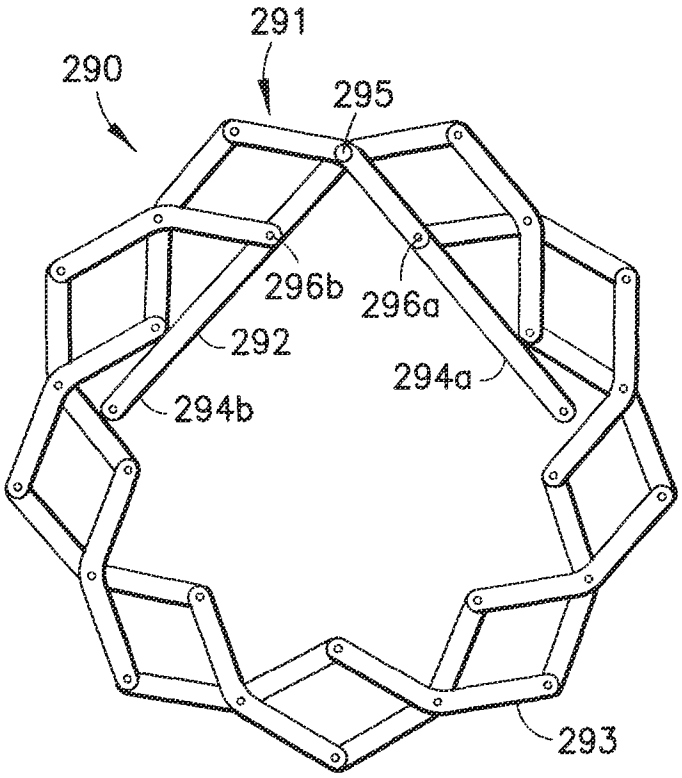
FIG. 14B illustrates an embodiment of a deployable structure system including an internal lever actuator according to the present invention.
Figure 14A:
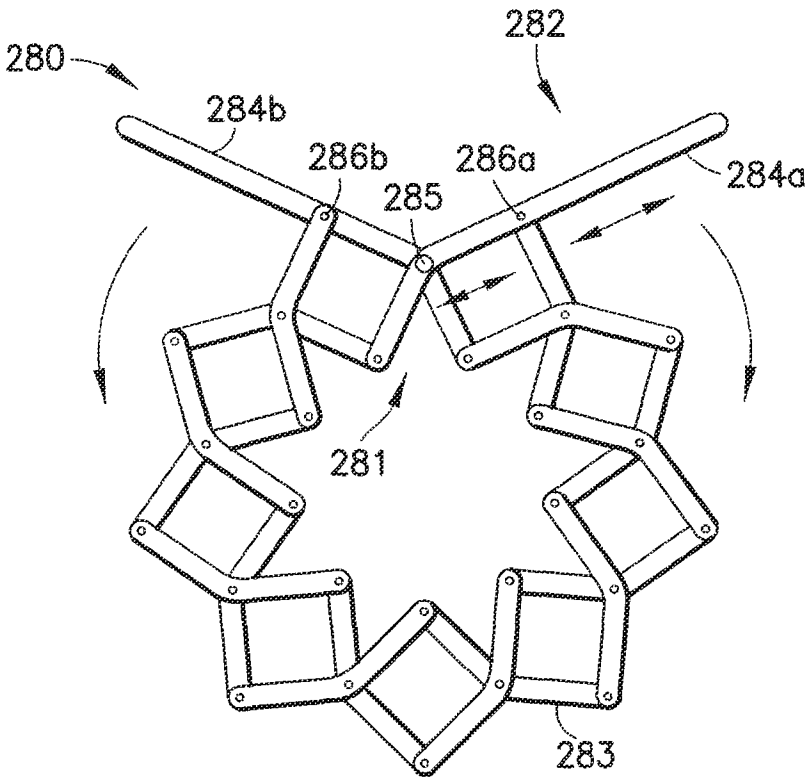
FIG. 14A illustrates an embodiment of a deployable structure system including an external lever actuator according to the present invention.

An exemplary embodiment of a reversibly actuatable expandable structure 280 including a reversibly expandable enclosed mechanical linkage having a lever-type actuator 282 is shown in FIG. 14A. In this embodiment, a pair of lever 284*a*, 284*b* (generally 284) are included in at least one of the basic modules 281. For example, the levers 284 can be formed from extensions of the angular members of the basic module 281. As shown in this example, the levers 284 extend outward from the outer pivot points 286*a*, 286*b* of the basic module 281. A torque applied to the levers 284 is directly transferred to the angled elements of the basic module 281 causing their rotation about the central pivot 285. The ends of the levers can be forced towards each other, urging the basic module 281 into a collapsed configuration. By its interconnection to other basic modules of the reversibly expandable structure 283, the structure 283 itself is urged into a collapsed state. Applying an operative directed torque urging the ends of the levers away from each other transitions the basic module 281 to an expanded configuration, thereby causing the reversibly expandable structure 283 to transition to its expanded state. With the levers disposed externally to the reversibly expandable structure, the configure is better suited for applying force internal to the structure. Actuation of the levers can be accomplished manually, or preferably with a length adjustable device, such any of the linear actuators 201 described in relation to FIG. 8A and FIG. 8B.

An alternative configuration of a reversibly actuatable expandable structure 290 including an reversibly expandable enclosed mechanical linkage 293 having a lever-type actuator 292 is illustrated in FIG. 14B. The lever-type actuator 292 also includes lever extensions 294*a*, 294*b* (generally 294) that extend inwardly from inner pivot points 296*a*, 296*b* along each of the angled elements of the basic module 291. Applying a torque urging the lever ends 294 together transitions the reversibly expandable structure 293 to a collapsed state, whereas urging the ends of the levers 294 apart from each other transitions the reversibly expandable structure 293 to an expanded state. Such configurations with levers 294 positioned along the inner portions of the reversibly expandable structure 293 are well-suited for applications in which a force is to be applied along an external perimeter of the reversibly expandable structure 293. In either configuration of the lever-type actuators 284, 294, it is important to note that the pivot point 285, 295 of the actuated basic module 281, 291 moves along a radius with respect to a center of the reversibly expandable structure 283, 293. Such actuation may be challenging for applications in which the reversibly expandable 283, 293 structure is to remain centered about a fixed location. At least one or both of the lever-type actuators 284, 294 and the reversibly expandable structure 283, 293 will tend to move during actuation. In order to maintain the expandable structure fixed, the pivot point of the lever-type actuators 284, 294 would have to travel along the radius according to the rate of expansion or contraction of the reversibly expandable structure 283, 293.

Figure 15B:
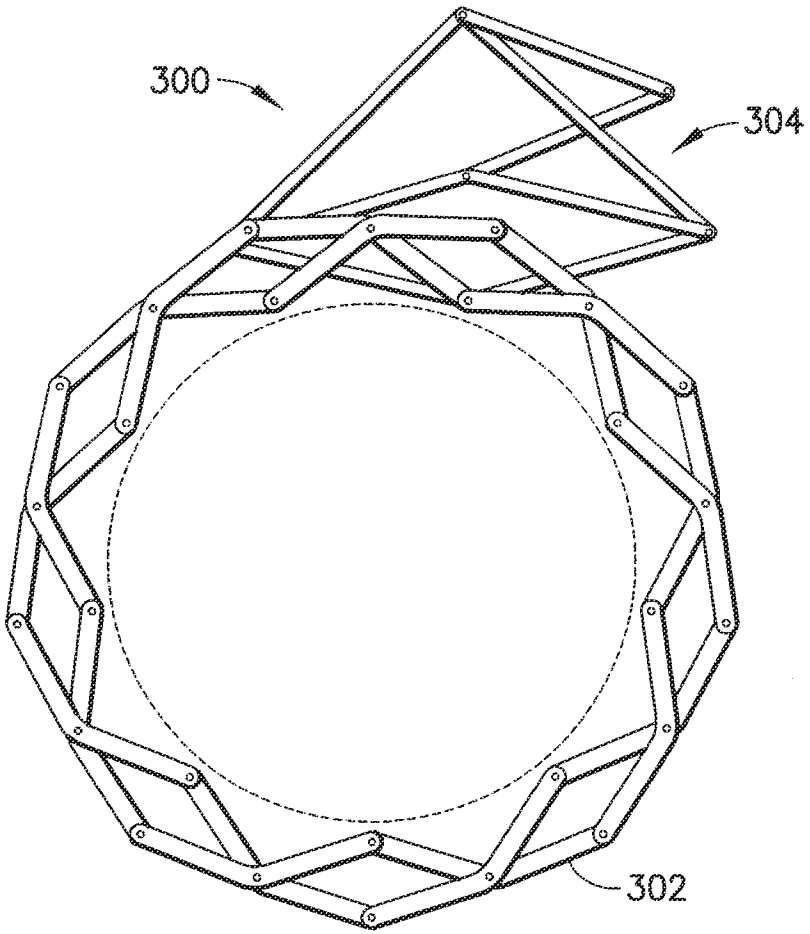
FIG. 15A and FIG. 15B respectively illustrate a planar diagram of an embodiment of a deployable structure system with an embodiment of an external Peaucellier-Lipkin type actuatable linkage according to the present invention in collapsed and expanded states.
Figure 15A:
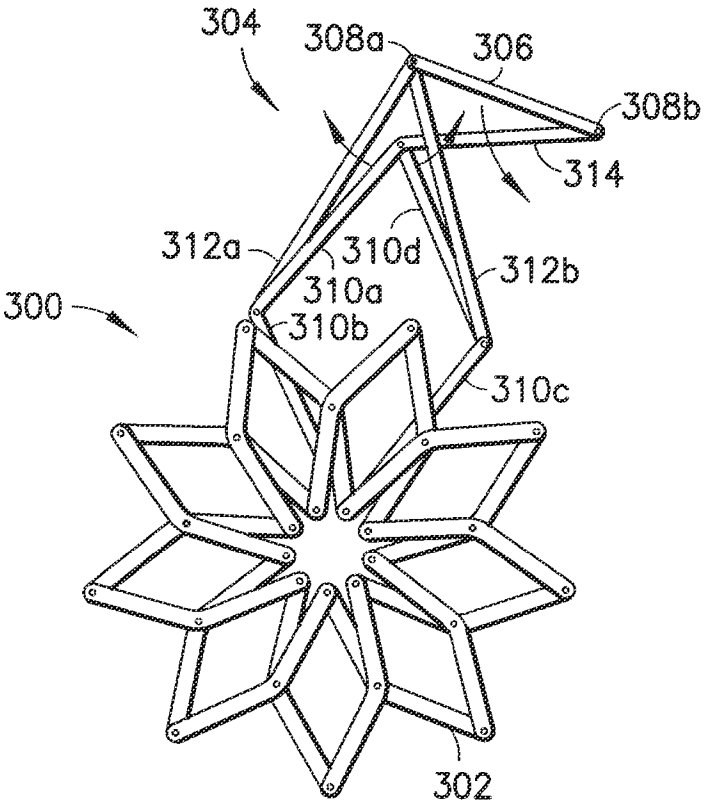

There exists at least one class of external linkages configured to convert rotary motion to linear motion referred to as Peaucellier-Lipkin linkages. FIG. 15A illustrates an exemplary embodiment of an actuatable deployable structure system 300 including a reversibly expandable structure 302 coupled to an external Peaucellier-Lipkin type actuatable linkage 304. The actuatable linkage 304 includes a fixed baseline 306 separating two pivot points 308*a*, 308*b* and a pivotal linkage of seven rigid struts. Four struts of equal length 310*a*, 310*b*, 310*c*, 310*d* (generally 310) are arranged in a parallelogram pivotal about its corners. One corner is attached to the reversibly expandable device 302, for example at one of its internal pivot points. Two other equal length struts 312*a*, 312*b* (generally 312) are each coupled at one end to a first pivot point 308*a* of the baseline 306, and at an opposite end to opposing corners of the parallelogram 310. A seventh strut 314 is coupled between a fourth corner of the parallelogram 310 and a second pivot point 308*b* of the baseline 306. The corners of the parallelogram 310 coupled to the seventh strut 314 and the reversibly expandable structure 302 can be revered to as radial corners, since they lie on a radius of the expandable structure 302. The other two corners of the parallelogram 310 can be referred to as tangential corners.

Rotation of the seventh strut 314 about the second pivot point 308*b* urges the attached radial corner of the parallelogram 310 towards a center of the reversibly expandable structure 302. Since the baseline is fixed 306 with respect to the reversibly expandable structure 302, and the tangential corners of the parallelogram 310 are pivotally connected to the first pivot point 308*a*, the opposite radial corner of the parallelogram 310 is drawn radially out from the center of the reversibly expandable structure 302. Thus, rotation of the seventh strut 314 about its pivot 308*b* results in a linear motion of an inner radial corner along a radius of the reversibly expandable structure 302. Beneficially, the reversibly expandable structure remains centered about the same point during transformation between expanded and collapsed states. The actuatable deployable structure system 300 is shown in an expanded state in FIG. 15B.

Figure 16B:
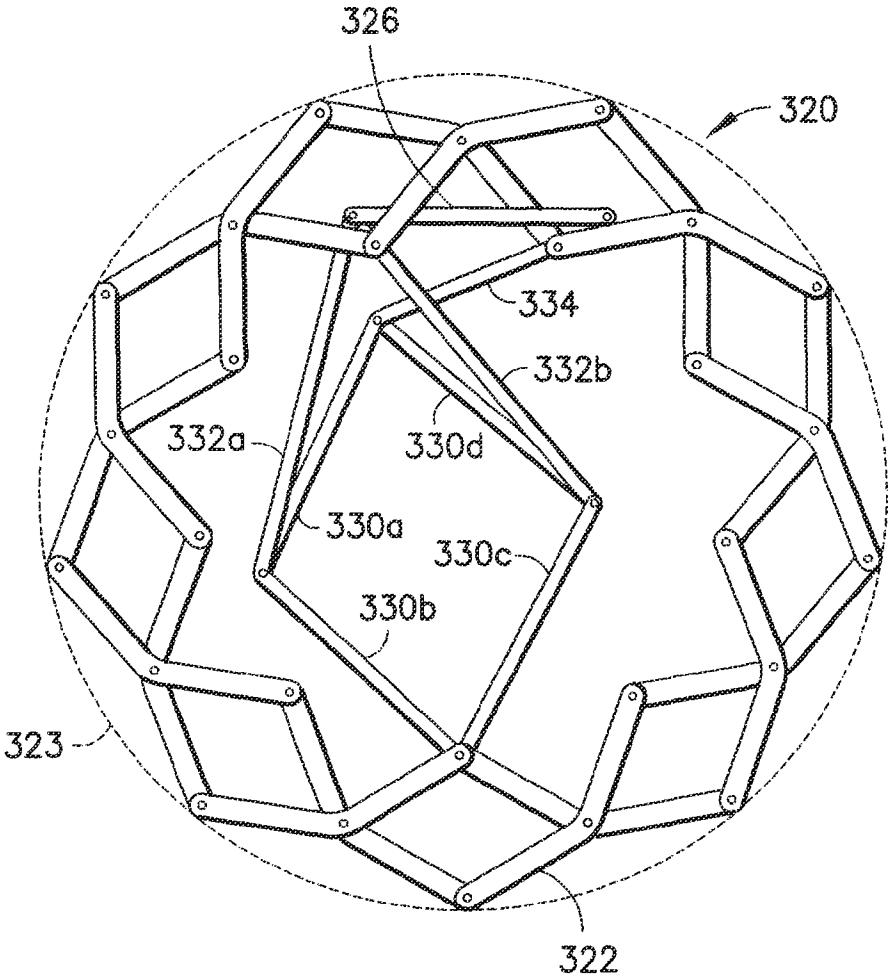
FIG. 16A and FIG. 16B respectively illustrate a planar diagram of an embodiment of a deployable structure system with an embodiment of an internal Peaucellier-Lipkin type actuatable linkage according to the present invention in collapsed and expanded states.
Figure 16A:
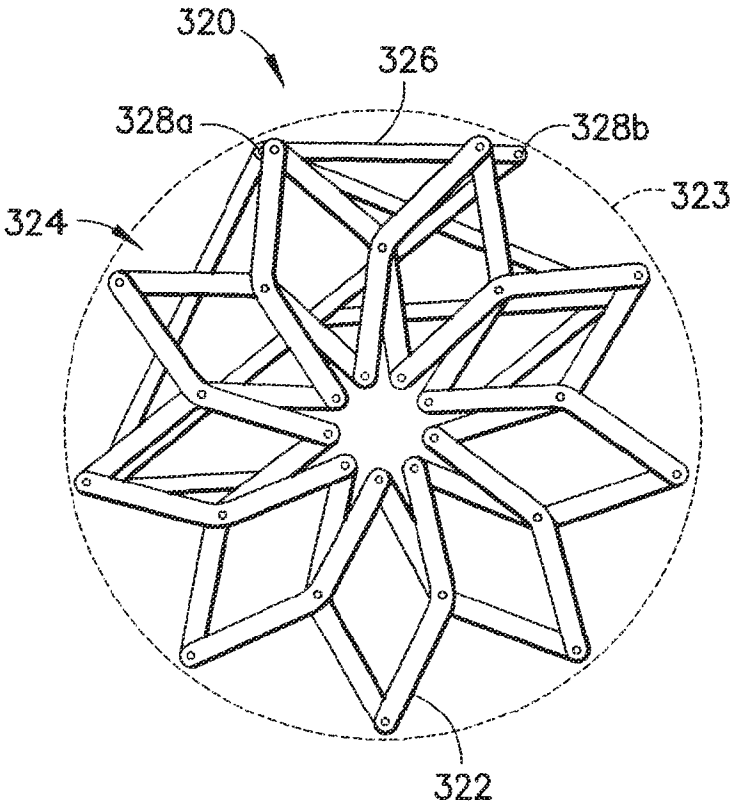

The baseline of the Peaucellier-Lipkin type actuatable linkage 304 is positioned external to the reversibly expandable structure 302 for applications in which an interior perimeter of the reversibly expandable structure 302 is used for applying a force. FIG. 16A and FIG. 16B respectively illustrate a planar diagram of an actuatable deployable structure system 320 including a reversibly expandable structure 322 coupled to an internal Peaucellier-Lipkin type actuatable linkage 324. The actuatable linkage 324 includes a fixed baseline 326 separating two pivot points 328*a*, 328*b*, and a pivotal linkage of seven rigid struts 330*a*, 330*b*, 330*c*, 330*d* (generally 330), 332*a*, 332*b* (generally 3132) and 334 arranged similar to the external actuatable linkage 304. In some embodiments, the entire actuatable linkage 324 is contained with a perimeter 323 of the reversibly expandable device 322 in its collapsed state (FIG. 16A), in its expanded state (FIG. 16B), and any state in between. Consequently, the baseline 326 of the Peaucellier-Lipkin type actuatable linkage 324 is positioned internal to the reversibly expandable structure 322 for applications in which an exterior perimeter 323 of the reversibly expandable structure 322 is used for applying a force.

Figure 17A:
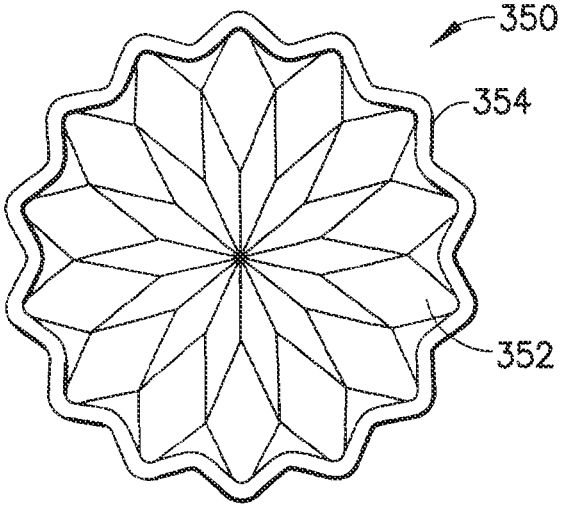
FIG. 17A and FIG. 17B respectively illustrate a planar view of an embodiment of a actuatable deployable structure system including a closed mechanical linkage of angulated elements having an external compliant layer according to the present invention in collapsed and expanded states.
Figure 17B:
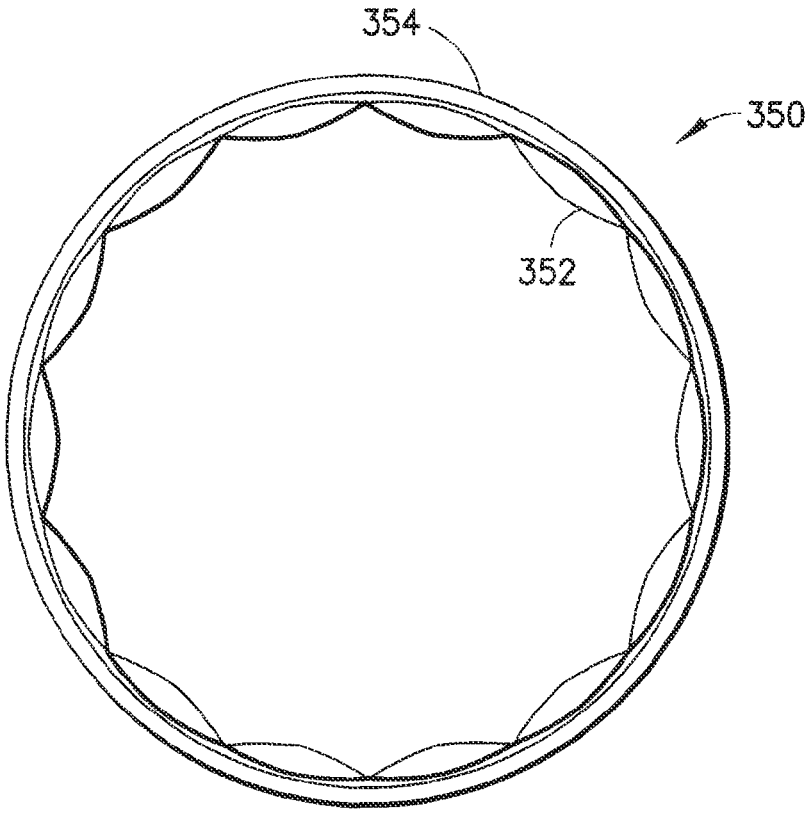

FIG. 17A and FIG. 17B respectively illustrate a planar view of another embodiment of an actuatable deployable structure system 350 including a closed mechanical linkage 352 of angulated elements having an external compliant layer 354. In some embodiments, the compliant layer 354 is provided as a sleeve configured to snugly engage a perimeter of a fully expanded mechanical linkage 352. As shown, the compliant layer 354 is positioned against an exterior perimeter of the reversibly expandable linkage 352. This configuration is particularly advantageous when the structure 350 transfers a force to another body using its external perimeter. The compliant layer can be used for protection as a buffer during operation. Alternatively or in addition, the compliant layer can be used to conform a perimeter of the structure 350 to an adjacent surface when deployed. For example, a compliant surface along an external perimeter can be used to conform to an inner perimeter of a cylindrical space in which the device 350 is deployed. Such a deployment may include sealing a portion of a well.

The compliant layer 354 or sleeve can be retained in this position by frictional engagement. Alternatively or in addition, the compliant layer 354 can be attached to the reversibly expandable linkage with mechanical fasteners, such as screws, clips or staples, with chemical fasteners, such as adhesives, or bonding, or by a combination of two or more of these fasteners. In some embodiments, the compliant layer can be positioned against an interior perimeter of the reversibly expandable linkage. This is particularly advantageous when the structure 350 transfers a force to another body using its internal perimeter.

The compliant layer 354 can be a continuous layer that may be provided as a continuous sleeve of compliant material. The compliant layer can be a discontinuous layer that may be provided as segments against selected perimeter surfaces of one or more basic modules of the reversibly expandable structure 352. For example, the compliant layer can be formed using compliant pads attached to at least one of an interior and exterior perimeter surface of at least some of the basic modules of the reversibly expandable structure 352. When applied to all of the interior or all of the exterior surfaces of all of the basic structures of the reversibly expandable structure 352, a smooth continuous compliant layer can be obtained transformed in at least one of the collapsed or expanded states.

The compliant material can be formed from one or more polymers, rubbers, elastomers or foams. In some embodiments the compliant layer 354 includes more than one layer of compliant material. For example, a binary layer device includes two adjacent compliant layers that can have the same or different compliant properties. In some embodiments, a first compliant layer is relatively dense providing a coarse fit, while a second layer is relatively less dense providing a fine layer. The fine layer can be positioned against one of the reversibly expandable structure or an external body, depending upon which surface requires a fine seal.

The deployable structure systems described herein can be used in a wide variety of applications, including drilling and well applications. At least some of these applications related to drilling and wells include conveying material outward in a radial direction into a casing or open hole formation. The systems can also be used as part of robotics module for tractoring or crawling inside cylindrical spaces, such as casings or open holes.

While this invention has been particularly shown and described with references to preferred embodiments thereof, it will be understood by those skilled in the art that various changes in form and details may be made therein without departing from the scope of the invention encompassed by the appended claims.

What is claimed is:

1. A reversibly expandable structure for transferring a force to a body in a wellbore, comprising:

an enclosed mechanical linkage including a plurality of pivotally joined kinematics modules reversibly expandable between expanded and collapsed configurations;

an actuator coupled with at least one of the plurality of pivotally joined kinematics modules, the actuator being configured to provide an actuation force which varies a diameter of the enclosed mechanical linkage and adjusts the at least one of the plurality of pivotally joined kinematics modules between open and closed configurations, adjustment of the at least one pivotally joined kinematics module inducing adjustment of the enclosed mechanical linkage between expanded and collapsed configurations, wherein variation of the diameter of the enclosed mechanical linkage produces a force acting upon the body in the wellbore; and wherein the expanded configuration is a hollow closed loop.

2. The reversibly expandable structure of claim 1, wherein the enclosed mechanical linkage defines an annular structure about a central axis having an external perimeter and an internal perimeter, wherein at least one reversibly expanding dimension is orthogonal to the central axis.

3. The reversibly expandable structure of claim 2, further comprising at least one additional enclosed mechanical linkage stacked along the central axis and also reversibly expandable between expanded and collapsed configurations.

4. The reversibly expandable structure of claim 1, further including a compliant layer disposed along at least a peripheral portion of at least some of the plurality of pivotally joined kinematics modules.

5. The reversibly expandable structure of claim 1, wherein at least some of the plurality of pivotally joined kinematics modules are planar, subtending an area of the enclosed mechanical linkage an overall larger area variable with the open and closed configurations.

6. The reversibly expandable structure of claim 1, further including a locking element configured to lock at least one pivotally joined kinematics module of the plurality of pivotally joined kinematics modules in a preferred adjustment between the open and closed configurations.

7. The reversibly expandable structure of claim 6, wherein the locking element includes a ratchet assembly having a toothed surface along at least one of the plurality of pivotally joined kinematics modules and a pawl adapted to engage at least a portion of the toothed surface engagement of the pawl and the toothed surface allowing movement of the toothed surface with respect to the pawl in a preferred direction only, the ratchet assembly allowing one of expansion or contraction of the enclosed mechanical linkage, while preventing an opposite one of expansion or contraction, of the enclosed mechanical linkage.

8. The reversibly expandable structure of claim 1, wherein the actuator is a rotary actuator providing an actuation torque transferable to the at least one of the plurality of pivotally joined kinematics modules.

9. The reversibly expandable structure of claim 8, wherein the rotary actuator comprises an electric motor.

10. The reversibly expandable structure of claim 1, wherein the actuator is a linear actuator providing a linear actuation force transferable to the at least one of the plurality of pivotally joined kinematics modules.

11. The reversibly expandable structure of claim 10, wherein the linear actuator is selected from the group consisting of: pneumatic pistons; hydraulic pistons; bolt-and-screw drives; piezoelectric devices; phase change materials; solenoids; and linear electric motors.

12. The reversibly expandable structure of claim 1, further comprising a linkage configured to transfer the actuation force between the actuator and the at least one of the plurality of pivotally joined kinematics modules.

13. The reversibly expandable structure of claim 12, wherein the linkage comprises a first gear fixedly coupled to the at least one of the plurality of pivotally joined kinematics modules and a second gear in communication with the first gear, wherein rotation of the second gear induces a rotation of the first gear for adjusting the at least one of the at least one of the plurality of pivotally joined kinematics modules between open and closed configurations.

14. The reversibly expandable structure of claim 13, wherein the linkage comprises a belt and pulley system transferring torque from the actuator to the at least one of the plurality of pivotally joined kinematics modules.

15. The reversibly expandable structure of claim 1, wherein the actuator is configured to provide a mechanical advantage in response to the actuation force.

16. The reversibly expandable structure of claim 1, wherein the actuator comprises a first member including at least one radial track and an overlapping second member including at least one spiral track, intersection of the radial and spiral tracks of the overlapping first and second members defining an anchor point configured for slideable coupling to an extension of a pivot of the enclosed mechanical linkage, wherein rotation of the first member transfers an actuation force to the pivot extension.

17. A method for transferring a force to a body, comprising:

providing an enclosed mechanical linkage including a plurality of pivotally joined kinematics modules, the enclosed mechanical linkage actuatable between collapsed and expanded states;

applying an actuation force to at least one of the plurality of pivotally joined kinematics module, the applied actuation force varying a diameter of the enclosed mechanical linkage; and positioning at least a portion of the enclosed mechanical linkage with respect to the body, wherein variation of the diameter of the enclosed mechanical linkage produces a force acting upon the body;

inserting the enclosed mechanical linkage into a wellbore; and positioning a sealing body between an external surface of the enclosed mechanical linkage and an adjacent surface of the wellbore, wherein the force acting upon the sealing body urges the sealing body against the adjacent surface of the wellbore for sealing an aperture in the adjacent surface of the wellbore.

18. The method of claim 17, wherein the act of applying an actuation force comprises transferring an actuation force from an actuator to at least one of the plurality of pivotally joined kinematics modules.

19. The method of claim 18, wherein transferring an actuation force from an actuator to the at least one of the plurality of pivotally joined kinematics modules comprises:

rotating a first disk including at least one overlapping slot with respect to an overlapping second disk including at least one slot, whereby overlapping intersection of slots of the first and second slotted disks defines an anchor point movable with rotation of the first and second; and slideably engaging within the anchor point a pivot extension of at least one of the plurality of pivotally joined kinematics modules, whereby relative rotation of the overlapping disks varies a diameter of the enclosed mechanical linkage.

20. The method of claim 17, wherein transferring an actuation force from an actuator to at least one of the plurality of pivotally joined kinematics modules comprises rotating a gear fixedly coupled to one of the plurality of pivotally joined kinematics modules, whereby rotation of the gear varies a diameter of the enclosed mechanical linkage.

21. The method of claim 17, further comprising applying force with the enclosed mechanical linkage over a distance resulting from variation of the diameter of the enclosed mechanical linkage between its collapsed and expanded states the applied force usable to do work over the distance.

22. The method of claim 17, wherein the act of positioning at least a portion of the enclosed mechanical linkage with respect to the body comprises coupling at least a portion of the enclosed mechanical linkage to a tool, wherein the force produced by the enclosed mechanical linkage urges the tool across a cylindrical surface of the wellbore.

23. A reversibly expandable structure, comprising:

an enclosed mechanical linkage including a plurality of pivotally joined kinematics modules, the enclosed mechanical linkage actuatable between collapsed and expanded states;

means for applying an actuation force in a radial direction to at least one of the plurality of pivotally joined kinematics modules, the applied actuation force varying a diameter of the enclosed mechanical linkage; and means for positioning at least a portion of the enclosed mechanical linkage with respect to a body, wherein variation of the diameter of the enclosed mechanical linkage produces a force acting upon the body; and wherein the expanded state is a hollow closed loop.

* * * * *